US010364604B2

(12) United States Patent
Biserna et al.

(10) Patent No.: US 10,364,604 B2
(45) Date of Patent: Jul. 30, 2019

(54) DEVICE AND METHOD FOR THE MOVEMENT AND MUTUAL ASSEMBLY OF SEGMENTS OF AN EXCAVATION BATTERY, FOR EXAMPLE AUGER OR ROD SEGMENTS

(71) Applicant: SOILMEC S.p.A, Cesena (FC) (IT)

(72) Inventors: Ezio Biserna, Longiano (IT); Danilo Fusaroli, Mercato Saraceno (IT); Francesco Mantovani, Cesena (IT)

(73) Assignee: SOILMEC S.P.A, Cesena (FC) (IT)

( * ) Notice: Subject to any disclaimer, the term of this patent is extended or adjusted under 35 U.S.C. 154(b) by 104 days.

(21) Appl. No.: 15/381,499

(22) Filed: Dec. 16, 2016

(65) Prior Publication Data

US 2017/0191313 A1 Jul. 6, 2017

(30) Foreign Application Priority Data

Dec. 18, 2015 (IT) ..... 102015000085226

(51) Int. Cl.
*E02D 7/00* (2006.01)
*E21B 3/02* (2006.01)
(Continued)

(52) U.S. Cl.
CPC ..... *E21B 3/02* (2013.01); *E21B 7/02* (2013.01); *E21B 10/44* (2013.01); *E21B 19/16* (2013.01);
(Continued)

(58) Field of Classification Search
CPC ..... E21B 10/44; E21B 19/16; E21B 19/18; E21B 3/02; E21B 7/02; E21C 5/00;
(Continued)

(56) References Cited

U.S. PATENT DOCUMENTS 2,735,703 A * 2/1956 Goodman ..... E21B 7/006 175/388
4,614,462 A * 9/1986 Itou ..... E02D 7/22 173/145
(Continued)

FOREIGN PATENT DOCUMENTS

CA 2952138 A1 * 6/2017 ..... E21C 5/00
EP 0056635 A2 * 7/1982 ..... E02B 17/021
(Continued)

OTHER PUBLICATIONS

Italian Search Report for Corresponding Italian Application No. ITUB20159641 (dated Jul. 26, 2016) (2 Pages).

*Primary Examiner* — Jennifer H Gay
(74) *Attorney, Agent, or Firm* — Lucas & Mercanti, LLP

(57) ABSTRACT

A device is provided for the movement and mutual assembly of segments of an excavation battery. The device includes four parts: an upper joint, a lower joint, a flexible element and a stop element. The upper joint is connectable to a driving tube. The lower joint is connectable to one segment of the excavation battery. The flexible element connects the upper joint to the lower joint so that the lower joint slides along the flexible element. The stop element limits the sliding of the lower joint away from the upper joint, and includes a ballast with a diameter that is less than a diameter of an inner duct in one segment of the excavation battery.

9 Claims, 10 Drawing Sheets

(51) Int. Cl.
*E21B 7/02* (2006.01)
*E21B 10/44* (2006.01)
*E21B 19/08* (2006.01)
*E21B 19/16* (2006.01)
*E21B 19/18* (2006.01)

(52) U.S. Cl.
CPC ..... *E21B 19/18* (2013.01); *E21C 5/00* (2013.01); *E02D 7/00* (2013.01)

(58) Field of Classification Search
CPC .... E02D 7/00; E02D 7/22; E02D 7/14; E02D 7/06; E02D 11/00
See application file for complete search history.

(56) References Cited

U.S. PATENT DOCUMENTS 5,240,353 A 8/1993 Bower et al.
5,433,279 A * 7/1995 Tessari ..... E21B 19/16 173/147
5,630,477 A * 5/1997 Minatre ..... E21B 7/02 173/147
5,934,836 A * 8/1999 Rupiper ..... B09C 1/00 405/236
9,068,318 B1 * 6/2015 Gochis ..... E02D 5/56
2004/0076479 A1 * 4/2004 Camilleri ..... E02D 5/56 405/252.1
2009/0151934 A1 * 6/2009 Heidecke ..... E21B 3/02 166/250.01
2011/0048805 A1 * 3/2011 Bauer ..... E02D 5/34 175/57
2013/0075077 A1 * 3/2013 Henderson ..... E21B 19/08 166/77.1
2014/0196955 A1 * 7/2014 Queen ..... E21B 7/005 175/57
2016/0097177 A1 * 4/2016 Lebreton ..... E02D 27/12 405/237
2016/0138348 A1 * 5/2016 Kunec ..... E21B 19/165 166/380
2016/0145954 A1 * 5/2016 Helms ..... E21B 19/06 175/57
2016/0281432 A1 * 9/2016 Queen ..... E21B 10/44
2017/0284162 A1 * 10/2017 Schober ..... E21B 19/008

FOREIGN PATENT DOCUMENTS

EP 3081737 A2 * 10/2016 ..... E21B 3/02
GB 2229096 A 9/1990

* cited by examiner 1
10
11
12
13
14
15
19
20
21
22
23
24
25
26
27
29
30
31
32
40

DEVICE AND METHOD FOR THE MOVEMENT AND MUTUAL ASSEMBLY OF SEGMENTS OF AN EXCAVATION BATTERY, FOR EXAMPLE AUGER OR ROD SEGMENTS

CROSS-REFERENCE TO RELATED APPLICATION

This application claims the benefit of Italian Patent Application No. 102015000085226 filed Dec. 18, 2015, the contents of which are incorporated herein by reference.

FIELD OF THE INVENTION

The present invention refers to a device and a method for the movement and mutual assembly of segments of an excavation battery, like for example auger or rod segments.

In detail, the present invention refers to a device to be used as auxiliary tool for the movement and assembly or disassembly of auger or rod elements necessary for making up the relative excavation batteries thereof to be connected to a digging machine for the foundations field.

BACKGROUND OF THE INVENTION

The drilling of the ground to make foundation piles with medium/low depth is diffusely carried out with the continuous flight auger technology. In order to carry out this technology self-propelled machines are usually used, which are equipped with a tracked truck and with a tower to which a guide tower is constrained, through an articulation. Such a guide tower in working conditions is kept substantially vertical or with small inclinations. On said tower a rotary head slides, which is known as "rotary" and which is equipped with a driving tube under which the digging auger is connected. The digging auger is made of a battery of digging elements until a length is reached that is substantially equal to the depth to be reached. The rotary head imparts rotary movement onto the auger, whereas the thrusting devices drive it into the ground. The two combined rotation and translation movements can produce a descent of the auger in the ground in order to dig a foundation hole. During digging, the rotation of the auger in combination with the inclination of the coils causes a rising of the digging debris along the coils until they are brought to the surface. Once the end of excavation depth has been reached, the auger is progressively extracted from the ground, thanks to the lifting movement of the rotary head along the antenna, and at the same time it can also be kept in rotation. During this step the auger is therefore subjected to a torque and to a "pull" of external forces that generate a traction sufficient to overcome the weight of the auger itself, the weight of the ground on the coils and the friction that is generated between the coil and the walls of the excavation. Generally the coils have a hollow core so as to make a duct inside the auger and at the end of the excavation. In this way, it is possible to pump setting material from the outside through the core of the auger in order to fill the excavation during the lifting step thus obtaining the foundation pile. The auger is generally made of a lower bit and multiple auger elements or segments that are axially connected to one another in order to make up the auger of the desired length. Based on the depth intended to be reached and on the performance allowed by the machine, the number of auger segments to be used to make up the digging auger is chosen. The auger segments, but also the bits, generally consist of a central cylindrical shaft and of coils that wind around the shaft. The shaft mainly consists of a hollow tube of great thickness, which is equipped at its ends with connection elements or joints and which must have sufficient diameter and thickness so as to withstand the pushing and pulling forces and the torques that the rotary head transmits to the auger during the excavation step. The coils consist of flat metal sheets properly folded and inclined in order to wind around the shaft. The outer diameter of the coils determines the actual diameter of the excavation made. The auger segments have lengths limited generally to values comprised between 2 m and 12 m, such as to promote the transportation thereof, thus limiting the weight and bulk thereof. The diameters of the coils, on the other hand, are limited based on the powers and on the torques that can be delivered by the rotary heads of the machines on which they must be mounted.

An alternative technique for making foundation piles, applicable in suitable grounds, is that of compaction of the ground. In this case, using the same digging machine described, a battery of compacting rods, also called excavation battery, at the base of which a compacting tool is applied, is applied to the rotary head instead of the auger. Also in this case, the excavation battery and the tool are made to penetrate into the ground through pushing and rotation, but in this case there is no removal of ground. The ground is just moved and compressed laterally towards the walls of the hole being made, without carrying the debris to the surface. The compacting rod elements are comparable to an auger element without external coils and are therefore "smooth" on the outside, i.e. they have a constant circular section. Such elements thus consist of a cylindrical shaft, which is mainly made of a hollow tube of great thickness, equipped at its ends with connection elements or joints, and which must have sufficient diameter and thickness so as to withstand the pushing and pulling forces and the torques that the rotary head transmits to the compacting tool during the excavation and lifting step. These rods as well are equipped with an inner duct that allows the passage of cement and therefore allows carrying out casting at the end of excavation and for the entire lifting from the bottom of the excavation.

In recent years, the increased power installed on the drilling machines, and therefore their increased performance, has led to a consequent increase in size of augers and rods that can be used. Currently, it is not rarely required to carry out foundation piles with diameter of 1,200 mm for a depth that tends to reach 30 m. For such great excavation depths, the composition of a drilling battery can thus require joining in situ four, five or more auger or rod segments.

Due to the great torques delivered by modern machines, the use of male-female threaded joints to carry out the mutual connection of the digging auger or smooth compacting rod segments has now been abandoned. In fact, such a threaded connection has not proven to be sufficiently strong. For some years it has thus been opted to join through male and female joints with prismatic section, for example square or hexagonal, capable of transmitting high torques, whereas the locking of the axial movement, in extraction, between two adjacent pieces is entrusted to transverse pegs and/or pins, of increasingly great size, in order to withstand the forces of the extraction members (winches, cylinders) that have also increased in line with the weight of the machines. Each auger segment has a male joint at one end and a female joint at the other end. The bit, on the other hand, has a single joint, which could be either male or female depending on the cases, positioned at the opposite end with respect to the digging direction. In this way, the male joint of an auger segment can be inserted axially into the female joint of the adjacent segment to make up the auger. Between the female joint and the male joint a coupling of the prismatic type is thus made, which prevents relative rotations of the two segments with respect to the longitudinal axis of the excavation battery that coincides with the rotation axis of the auger or of the rod during digging. Thanks to the fact that relative rotations are impossible, when an auger segment receives torque and is set in rotation it transmits such a torque and such a rotation to the connected adjacent segments. The male joint can consist of a shaft section of limited axial length, for example equal to one or two times the diameter of the shaft, equipped with outer faces arranged to form a polygon, preferably a square or a hexagon. Such a polygonal shape is visible by observing the auger along its axial dimension or by sectioning the joint with a plane perpendicular to the longitudinal axis of the auger. The size of this polygonal section is preferably less than the outer diameter of the shaft of the auger. The female joint, on the other hand, can consist of a shaft section of length at least equal to the male joint with outer diameter equal to that of the shaft and comprising a polygonal-shaped inner recess corresponding to that of the male joint. The recess will have dimensions with slightly greater tolerances with respect to the male in order to allow an easier axial insertion of the male joint into the female joint. The male joints and the female joints will also have transverse recesses, preferably with circular section, with axis arranged perpendicularly with respect to the axis of the auger, in order to allow the insertion of locking pins or pegs. Once inserted, each pin is in contact both with the male joint and with the female joint, thus preventing a relative axial sliding thereof in the direction of the longitudinal axis of the auger. The pins thus support the load of axial pull applied to the auger during the extraction step from the ground.

The prior art just described has some drawbacks.

At the start of the worksite, before making the excavation for the first pile, it is necessary to "make up" the excavation battery by assembling to one another some digging, auger or rod segments, until the desired length functional to the depth of the excavation is reached. Such segments are in fact stored on the worksite in mutually disconnected configuration, in order to limit the bulk thereof and to facilitate the movement thereof. The auger segments, or the rod, are assembled to one another under the rotary head at the tower of the machine to then connect the final rod or auger to the rotary head itself.

The known digging machine is, therefore, equipped with lifting means that favour the lifting and assembly maneuvers of the digging segments. Typically, the lifting means comprise a service winch equipped with a cable that is sent to pulleys arranged on the top of the guide tower and is then made to descend to the plane of the ground to be able to hook the segments to be lifted. Even in the case in which these lifting means are available to lift the auger or rod segments and to connect them to one another by engaging the respective male and female joints, it is still necessary to have an aerial service platform through which the upper part of the piece of segment that is wished to be added or removed, arranged vertically under the rotary head, must be reached, in order to insert the pegs or pins that connect said segment to the lower end of the battery that is already partially made up. Such an operation is to be repeated for each new segment added or subtracted and for the respective jointed connection. This insertion maneuver is carried out manually by trained workers operating, therefore, from an aerial platform that sometimes must reach 6-12 meters in height, based on the length of the auger segments that are coupled or based on the total length of the auger that is wished to be obtained. This maneuver, since it is carried out at a height, always involves a certain risk and requires the use of machinery, the aerial platform, distinct from the digging machine. The use of the platform also increases the worksite costs and can be difficult in worksites with limited space that reduces accessibility of the platform near the digging machine.

An alternative solution to the use of the aerial platform, in order to facilitate the composition of a battery of augers, is to use a "service well", i.e. an excavation made previously in the ground and emptied of the excavated earth. Such an excavation, therefore, must have a greater diameter and depth with respect to the battery of augers or rods to be made up. For example, if it is necessary to mount a bit that is two meters long with two auger segments that are each six meters long, in the presence of a service well it is possible to follow the following procedure:

a) arranging the bit inside the mouth of the well, fixing it axially to the mouth of the well itself so that its upper end, usually equipped with female half-joint, projects slightly from the ground. A typical locking or sustaining method is to insert bars of greater diameter with respect to the well between the coils, so that they also rest beyond the edges of the mouth, thus preventing them from falling into it;
b) positioning the first six-meter auger segment in raised position above the bit, through the service winch of the machine itself or through an external crane. As known, it is necessary to angularly phase the two joints of the segments to be connected to then lower the auger segment so that the male joint inserts axially into the female one and then the bit and the adjacent segment are fixed axially through the insertion of the transverse pegs. The insertion of the locking pegs can thus be carried out by workers on the ground, since the joint is at a low height with respect to the ground;
c) through the service winch of the machine or by means of an external crane, the battery partially formed by the two assembled segments is lowered for further six meters into the well, locking it on the mouth of the well as soon as the upper joint of the first six-meter segment is at a lower height with respect to the plane of the ground;
d) positioning the second six-meter segment raised above the previous one through the service winch of the machine itself or external crane. Like previously, at this point it is necessary to angularly phase the two joints before lowering the auger segment so that the male joint inserts axially into the female one and then the segments are fixed axially through the insertion of the transverse pegs;
e) through the service winch of the machine or by means of an external crane the entirely made up battery of auger segments is lowered for another six meters into the well and it is locked on the mouth when only the upper joint of the second 6m-segment extends beyond the edge of the well;
f) moving the rotary head and the driving tube associated with it down along the guide antenna until the lower joint of the driving tube is inserted axially into the upper joint of the second six-meter segment. Then the transverse pegs or pins are inserted to axially lock the auger to the tube and therefore to the rotary head.

At this point the auger, made of a battery of assembled segments, is ready for use and is fixed securely to the rotary head. Then the auger is completely extracted from the well, completely lifting the rotary head along the guide tower, and the machine is moved inside the worksite until the position of the first pile to be made is reached.

The service well, in brief, allows always fixing the pegs close to the landscape plane, thus allowing the operation to be carried out by workers who keep their feet on the ground, thus without the aid of lifts.

However, the presence of a service well still remains a rarity due to some drawbacks, in particular due to the fact that the well is in a fixed point of the worksite, whereas the digging machines will work at many points and possibly with augers of different diameter according to the areas of the worksite. This involves that the machine, in order to carry out a change of augers, for example to modify the length or diameter thereof, will have to travel through the worksite to reach the well, where to make the change, and then return to the excavation area. This operation is complicated particularly in urban worksites with restricted spaces and, in any case, requires a long time due to the extremely low movement speeds of these digging machines. Moreover, the presence of a well on the worksite represents a danger, since in the case of a person accidentally falling the diameter of the well would allow the body to pass to the maximum depth. It is therefore clear that it is necessary to keep the well always covered and to cordon off the surrounding area when it is not in use.

In light of the problems linked to the service well, the procedure that is currently most frequently carried out on the worksite is as follows, which does not provide for the use of such a well.

a) Raising the rotary head until a raised position is reached along the guide antenna. By using the service winch, or an external crane, the bit of the excavation battery, which commonly is about two meters long, is arranged below the rotary table so that the longitudinal axis of the bit coincides as much as possible with the axis of the driving tube of the rotary head. Keeping the bit in a substantially vertical position possibly takes place by closing around it the openable guides with which a machine for continuous flight auger is generally equipped. These guides consist of two movable half-shells, constrained to the base of the guide tower, which can open or close by rotating on the horizontal plane to clutch or free the auger.

b) Lowering the rotary head and, after having angularly phased the lower joint of the tube with the upper joint of the auger segment, the two joints are engaged by making them slide axially inside one another. An operator climbs up a suitable ladder so that his/her hands reach the height at which the upper joint of the bit segment is located, generally two meters, and provides for engaging the transverse pegs that connect the digging segment with the tube of the rotary head.

c) By actuating the rotary head in rotation and in translation downwards, torque and thrust are applied to the segment until it is planted in the ground for about three quarters of its length.

d) The transverse pegs between the bit segment and the driving tube of the rotary head are extracted and the free rotary head is raised again to a height such as to free a space above the bit segment that is greater than the length of the next auger segment, for example six meters, which will be loaded to make up the auger.

e) Then the auger segment is lifted with the service winch of the machine, or with an external crane, and it is placed on the vertical of the bit segment planted in the ground. The lower joint of the auger segment is phased with the upper joint of the bit segment, the joints are engaged and the radial pegs are inserted.

f) With an aerial support platform for the operator that must be available on the worksite, a sufficient height is ascended to so as to insert the transverse pegs between the upper joint, generally female, of the segment just added and the lower joint of the driving tube of the rotary head. The platform, or basket, which carries the operator must therefore always reach a height at least equal to, but generally greater than, the length of the auger segment that is added, therefore, at heights that frequently exceed 6 meters, but could even reach 12 meters.

g) Once the joints have been secured with the pegs, torque and thrust are applied to the partially made up battery of augers until it is almost completely planted into the ground taking care to leave about a meter thereof, or in any case at least the entire upper joint, above the plane of the ground.

h) The fixing of the second six-meter digging segment on the first is carried out in the same way used to assemble the first auger segment on the bit segment.

The "elevated" intervention becomes necessary whenever an auger segment is added to the existing ones. The height depends on the length of the segment to be joined. The current safety standards in any case mandate the use of a service platform and of safety and protection devices for working at a height.

The operations are repeated for all of the successive auger segments that are wished to be added. The "elevated" intervention becomes necessary whenever an auger segment is added to the existing ones. In the absence of a service well and without the aid of accessories suitable for the purpose, it will always be necessary to have an elevator platform with which to raise workers to a few meters in height from the landscape plane to arrange the fixing of the transverse pegs that connect two adjacent auger segments to one another or that connect a segment to the tube of the rotary. The work is not simple since the workers need to drive in, or extract, pegs with a diameter of a few centimeters in seats having very precise tolerances that are necessary to eliminate the clearances, but that at the same time increase the friction and make the insertion difficult. Moreover, such insertions or extractions of the pins are carried out by worksite workers with a club, mallet, or ram thus requiring physical effort and exposure to the dangers deriving from the use of these clubs. The work position as well is not comfortable since the insertion maneuvers of the pins require that the shaft of the auger be reached, but at the same time the basket, or the platform, can approach only until reaching the outer edge of the coils. In the case of augers with coils of large diameter, the basket will thus be further from the shaft, requiring the operator to lean out and work in an uncomfortable position.

SUMMARY AND OBJECTS OF THE INVENTION

The purpose of the present innovation is therefore to make an innovative device for mounting and dismounting an excavation battery, such as an auger or a rod, made up of a plurality of digging segments.

Such batteries are dedicated to use on a drilling machine intended to carry out foundation excavations. The purpose of the present invention is also to implement an assembly and disassembly method associated with the use of the present device for moving and assembling segments of an excavation battery that on the one hand allows avoiding the "elevated" joining operation of the single segments that make up the excavation battery and on the other hand does not require the presence of service wells on the worksite. Thanks to the device and method of the present invention, all of the mounting and fixing operations of the single elements can be carried out at ground level, irrespective of the type, diameter and length of the augers involved. By doing so, the safety of the worksite workers will be improved during the steps of moving and assembling the auger segments or rod segments.

A further purpose of the device and method according to the present invention is to reduce the number of operations to be carried out for the assembly, in particular by eliminating the operations to be carried out at height.

These purposes according to the present invention are accomplished by making a device for moving and assembling or disassembling digging segments, augers or rods, necessary for making up the relative excavation battery to be connected to a digging machine for the foundations field, as outlined in claim 1. These purposes according to the present invention are accomplished by making a method for moving and assembling or disassembling segments of augers or rods necessary for making up the battery of augers or the battery of rods to be connected to a digging machine for foundations, as outlined in claim 8.

Further characteristics of the invention are highlighted by the dependent claims, which are an integral part of the present description.

BRIEF DESCRIPTION OF THE DRAWINGS

The characteristics and advantages of a device for moving and assembling elements of an excavation battery, like for example augers or rods, according to the present invention will become clearer from the following description, given as an example and not for limiting purposes, referring to the attached schematic drawings, in which.

Figure 1A:
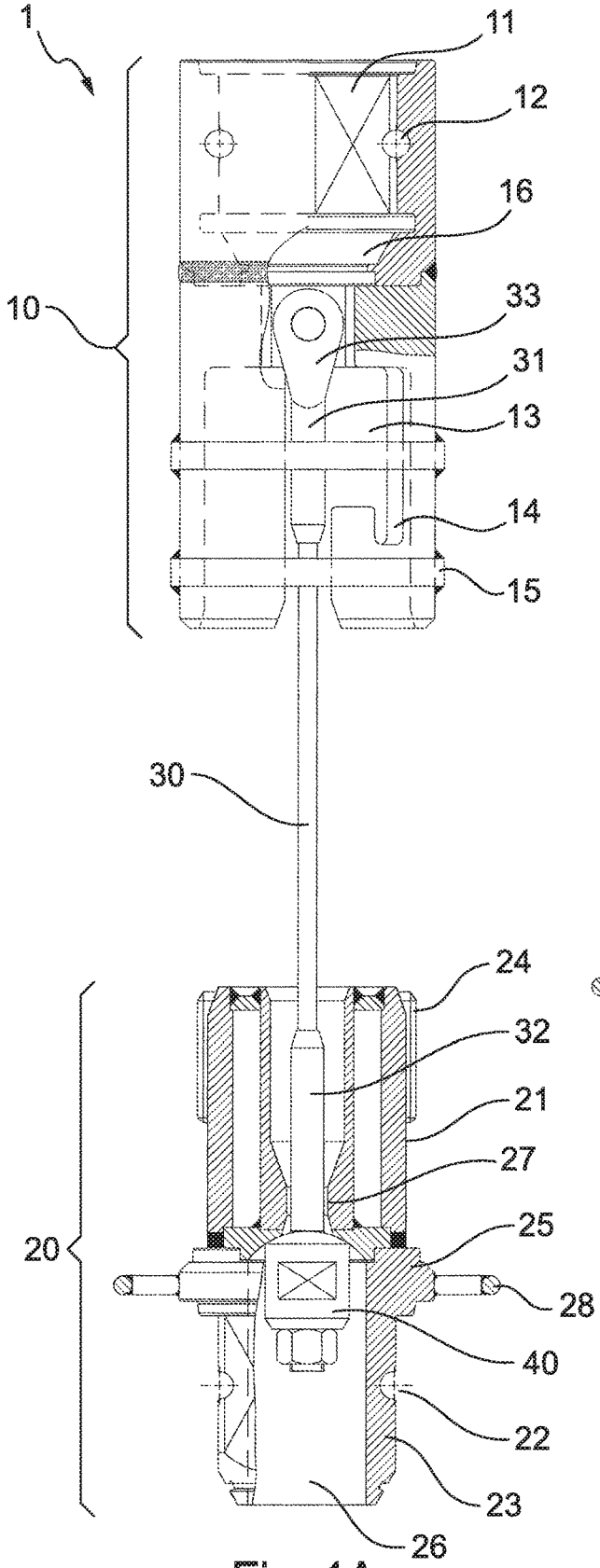
FIGS. 1*a* and 1*b* are partially sectioned lateral views of the device for moving and assembling digging segments of the present invention respectively shown in extended disengaged configuration (FIG. 1*a*) and in intermediate or partially extended configuration (FIG. 1*b*) and disengaged.

With reference to the figures, the device for moving and assembling the segments of an excavation battery, for example auger or rod segments, is wholly indicated with reference numeral 1.

DETAILED DESCRIPTION OF THE INVENTION

Such a device 1 comprises four distinct main components. A first element is an upper joint or coupler 10. This joint is defined as upper because in work condition it is located at a greater height from the ground with respect to the other elements of the device and is coupled to the tube of the rotary head of the digging machine.

In the rest of the description and with reference to the embodiment shown in the figures, reference will be made to the upper joint as "female" upper joint 10, even if such a joint could very well be of the male type according to the configuration of the tube of the rotary head.

Therefore, the female upper joint 10 comprises a body having a substantially cylindrical external shape of diameter comparable to that of the shaft of the digging segments, augers or rods, which is intended to be assembled in order to make the finished excavation battery.

The female upper joint 10 also comprises an upper female connection recess 11 and a lower female connection recess 13. The terms lower and upper are referred with respect to the rotary head 4 to which the female upper joint 10 couples during use.

As stated earlier, the recesses 11 and 13 can be replaced by male elements in the case in which the tube of the rotary head is of the female type.

A second element is a lower joint or coupler 20. This joint is called lower joint since, in work condition, it is located at a lower height from the ground with respect to the upper joint 10. The lower joint is defined "male" 20 because it is intended to couple to female elements.

Like for the upper joint, the male or female configuration is switchable according to needs.

Such a male lower joint 20 comprises a body that at least in its central area has a substantially cylindrical external shape, of diameter comparable to that of the shaft of the auger or rod segments that are intended to be assembled. The male lower joint 20 in turn comprises an upper male coupler 21 and a lower male coupler 23.

The female upper recess 11 of the female upper joint 10 acts as a joint of preferably prismatic shape, already described, compatible to couple with the lower joint 6, in this case male, present in the driving tube 5 of the rotary head 4. The female upper joint 10, at the female upper recess 11, also comprises the seats 12 for the pins or pegs for locking axial sliding, so as to be able to be fixed axially to the driving tube. Such a lower joint 6 of the driving tube 5 comprises seats corresponding with the seats 12 of the female upper joint 10 so that the pins or the transverse pegs engage both in the recesses of the female upper joint 10 and in the recesses of the tube 5 making them integral. The female upper joint 10 in its lower part is equipped with a lower cylindrical female recess 13 having bayonet openings 14 on its outer walls. In a preferred but not restrictive embodiment there are three bayonet openings 14 arranged equally spaced on the outer circumferentially surface of the female lower joint 13. In the lower part of the female joint 10 there is a plurality of reinforcing rings 15 that surround the outer surface of the joint at the bayonet openings 14 performing a belt function in order to strengthen the structure of the joint in this area and to prevent it from deforming in work conditions, i.e. when it will be subjected to torque or to axial loads. The female upper joint 10 is also passed through by an axial duct 16, having a variable shape and section, which connects the upper recess 11 to the lower recess 13, so that the entire female upper joint 10 results to be hollow for its entire axial length.

In the lower part of the male lower joint 20 there is a lower coupler 23, as stated earlier, preferably a male lower coupler, with section of polygonal prismatic shape suitable for coupling by inserting axially into the joint (preferably female) present in the upper part of all of the digging segments, auger or shaft, i.e. both the bit segments, and the intermediate segments that are needed to make up the excavation battery. The male lower coupler 23 of the male lower joint 20 is also equipped with seats 22 for the insertion of the pegs or pins that allow fixing it axially to the digging segment to be moved.

The upper male coupler 21 of the male lower joint 20 has a preferably cylindrical external shape, of suitable diameter and length so that it can insert axially into the female lower recess 13, also cylindrical, of the female upper joint 10. The inner surface of the female lower recess 13 and the outer surface of the upper male coupler 21 have corresponding shapes (preferably both circular) and slightly different sections so as to allow, at least in a usage step, partial relative rotations between the female upper joint 10 and the male lower joint 20 about the longitudinal axis of the joints. At least one abutment strip 24, having a substantially rectangular shape arranged with the longer dimension, i.e. the longitudinal one, parallel to the longitudinal axis of the upper male coupler 21, is fixed on the outer surface of the upper male coupler 21. In a preferred but not restrictive embodiment there are three strips equally spaced apart on the circumferential perimeter of the upper male coupler 21. Said strips 24 have suitable width and thickness to be able to insert through axial sliding into the bayonet openings 14 of the female upper joint 10. Furthermore, the male lower joint 20 is passed through by an axial duct 26, of variable shape and section, so that the entire male lower joint 20 results to be hollow for its entire axial length. In greater detail, the duct 26 has a necking 27 in its intermediate portion, i.e. a portion of the duct exists, which is characterised by a reduced diameter with respect to the remaining portions of the duct 26.

A third element that constitutes the moving and assembly device 1 is a flexible connection element 30, preferably a steel cable, which connects the female upper joint 10 to the male lower joint 20. Said flexible element 30, sized to bear the weight of the entire battery of auger or rod segments, at one end has an upper terminal or socket 31 configured to be connected to the female upper joint 10 and at the other end has a lower terminal or socket 32 configured to be connected to the male lower joint 20. The upper terminal 31 is locked axially, preferably through a hinge and a pin 33, inside the body of the female upper joint 10 at least partially inserting into the inner duct 16. Therefore, the upper terminal 31 thus always remains integral to the upper coupler, not being able to slide in the direction of the longitudinal axis of the joint 10. The terminal 31 can only perform small rotations about the connection pin 33 so that the longitudinal axis of the terminal 31 can tilt with respect to the longitudinal axis of the female upper joint 10.

During the assembly of the moving and assembly device 1, the lower part of the flexible element 30, also comprising the lower terminal 32, is made to pass through the inner duct of the male lower joint 20 and through the necking 27 so that the lower terminal 32 projects completely below (outside) the male lower joint 20. At this point, the lower terminal 32 of the flexible element 30 is connected to the fourth element 40 that constitutes the moving and assembly device 1. This is a ballasted stop element 40 that also acts as a counterweight. Such a stop element 40 is fixed and made integral to the lower terminal 32 of the flexible element 30 through a locking system 41, for example through a nut 41. In a preferred embodiment, the stop element 40 has a hole or duct that crosses it so that a part of the lower terminal 32 can be inserted into such a hole crossing the entire body of the stop element 40 projecting outside it. The locking system 41 is fixed to the projecting part of the terminal 32 that is preferably threaded, for example by screwing the nut 41. At this point, the moving and assembly device 1 results to be completely mounted for use in work conditions. Once mounted, the moving and assembly device 1 allows the male lower joint 20 to slide axially with respect to the female upper coupler 10 for the entire free length of said flexible element 30 until either the upper stop position or the lower stop position is reached, as it will be better described with reference to FIGS. 1, 2 and 3. The lower stop position, also called decoupled extended configuration of the device 1, is clearly visible in FIGS. 1A (sectioned) and 3B (perspective). The lower stop position is determined by the mechanical abutment of the stop element 40 against the necking 27 of the duct 26 of the male lower joint 20. With reference to FIG. 1A, the device 1 is shown oriented according to the work position, i.e. arranged vertically with the female upper joint 10 raised further from the ground and the male lower joint 20 lower down closer to the ground. In this extended lower stop condition, the male lower joint 20 results to be axially locked in the translation movement downwards. Such locking is caused by the fact that the stop element 40 has a sufficiently small diameter to get into the cavity 26 of the male lower joint 20, but too big to pass through the necking 27. Therefore, the element 40 will rest at the necking 27. In this decoupled or disengaged extended configuration visible in FIGS. 1A and 3A, thanks to the flexibility of the element 30 that can deform, the device 1 allows transverse and angular offsetting between the male lower joint 20 and the female upper joint 10. In particular, the male lower joint 20 can take up a configuration in which its longitudinal axis is tilted with respect to the longitudinal axis of the female upper joint 10 with inclinations that can also exceed ninety degrees, as it can be seen in FIGS. 5A and 5B that will be detailed hereinafter. Transverse offsetting is also permitted, for example by keeping the two longitudinal axes of the female upper joint 10 and of the male lower joint 20 parallel, but not coaxial. Combinations of transverse and angular offsetting are also possible.

Figure 1B:
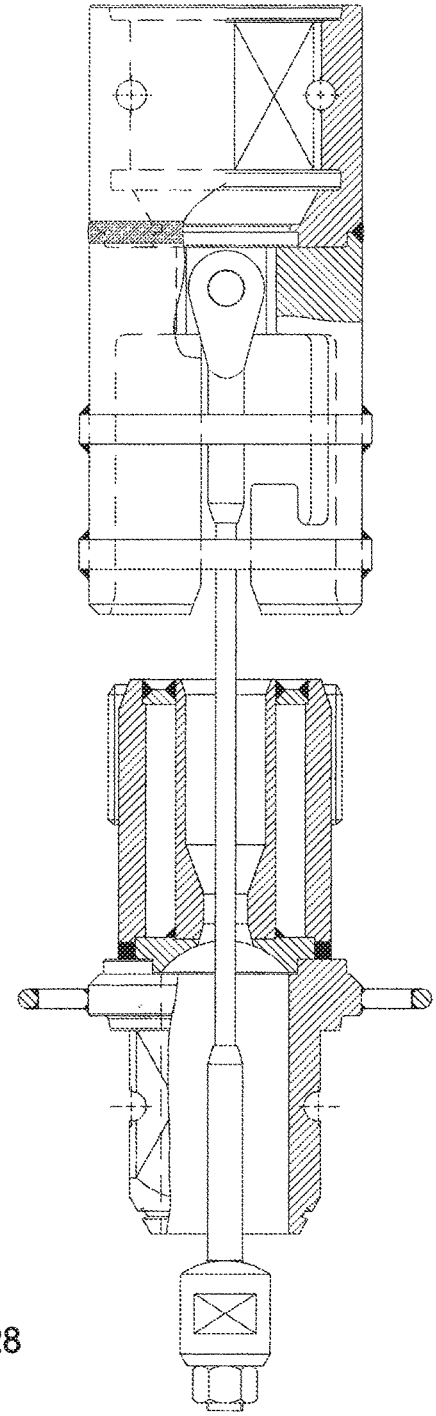

From the extended decoupled condition, the male lower joint 20 can be made to translate axially along the flexible element 30 so that it approaches the female upper joint 10 thus taking the device 1 into an intermediate disengaged or decoupled condition visible in FIG. 1B. In this intermediate decoupled configuration, the device 1 again allows transverse and angular offsetting between the male lower joint 20 and the female upper joint 10 and allows the axial sliding of the male lower joint 20 both in the direction approaching to and in the direction away from the female upper joint 10, but only until either the upper stop position or the lower stop position is reached. In this intermediate condition the flexible element 30 and the stop element 40, due to the weight of the latter, behave like a plumb line. The ballasted stop element 40 tends to keep the flexible element taut and vertical and, consequently, tends to come out of the duct 26, thus going into a position below the lower edge of the male lower joint 20.

The ballasted stop element 40 has the dual function of bearing the weight of the male lower joint 20 and all of the digging segments, of auger or rods connected to it when the lower coupler reaches the end stroke or mechanical abutment position with respect to the flexible element 30, and the function of descending below the lower coupler to "drop" into the duct some concrete present in the core of the auger or rod segment connected to the male lower joint 20, thus keeping the cable taut so as not to create encumbrance and obstacle in the maneuvers that will be hereinafter described, for the movement or assembly of the batteries of augers or rods. The length of such a flexible element 30 is not constrained to a single permitted value, it can be selected within a range of lengths, but it must be less than the length of the central duct present in the shortest element among those to be joined to make up the battery. Usually, such a shortest element is the bit segment.

Figure 2A:
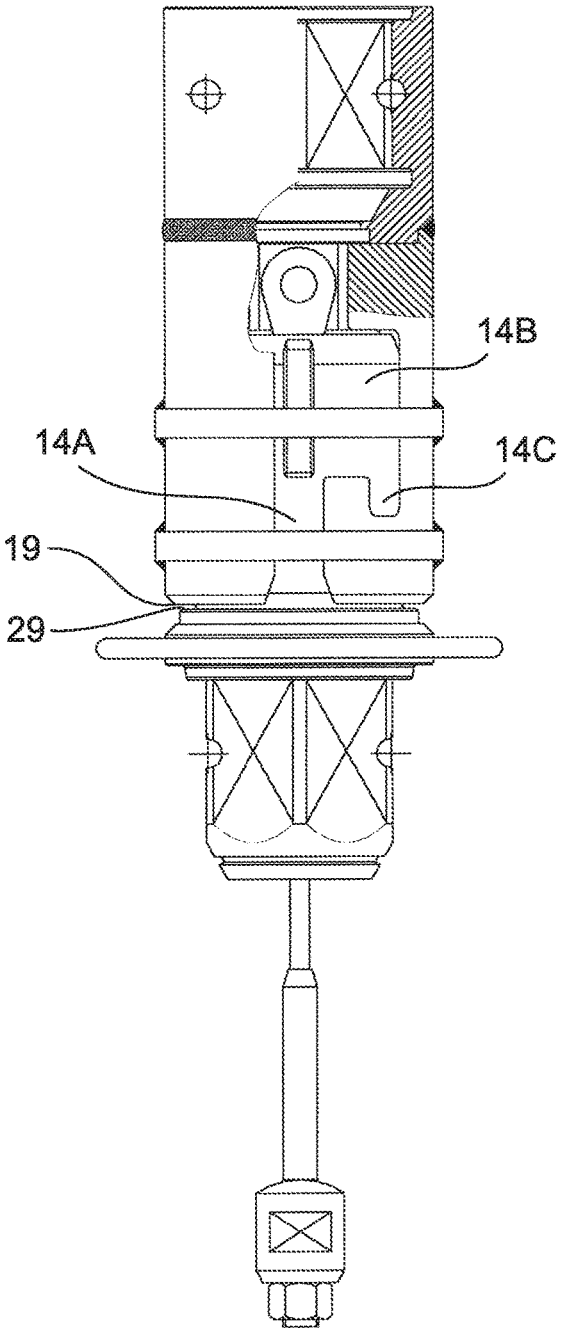
FIGS. 2*a* and 2*b* are partially sectioned lateral views of the moving and assembly device shown in contracted and partially coupled or partially engaged configuration (FIG. 2*a*) and in contracted and completely coupled or completely engaged configuration (FIG. 2*b*)
Figure 2B:
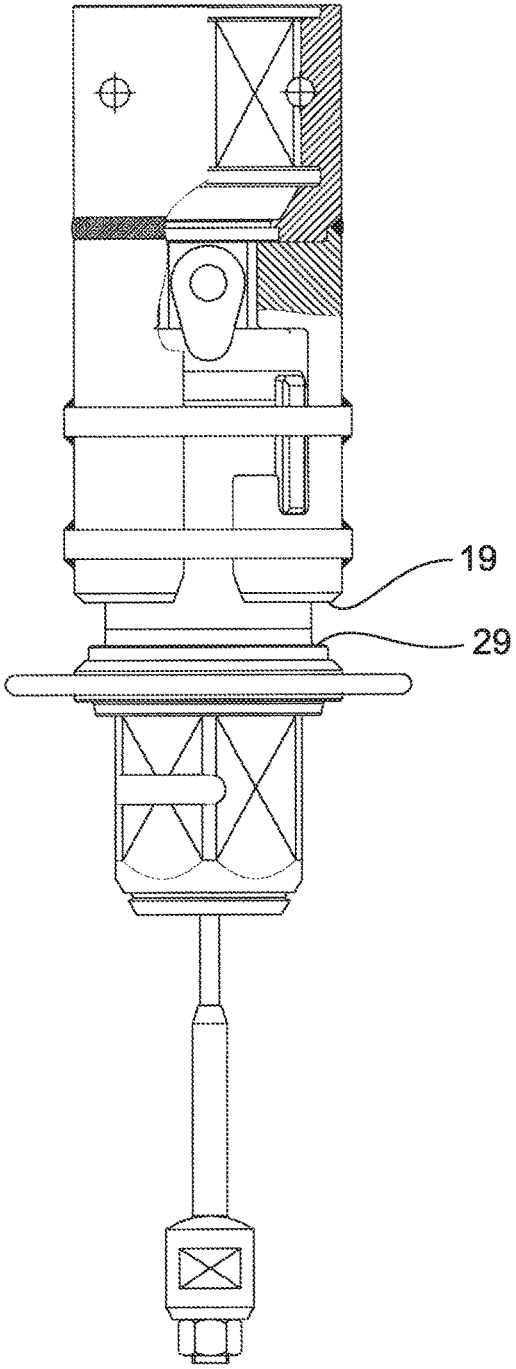
Figures 3A, 3B:
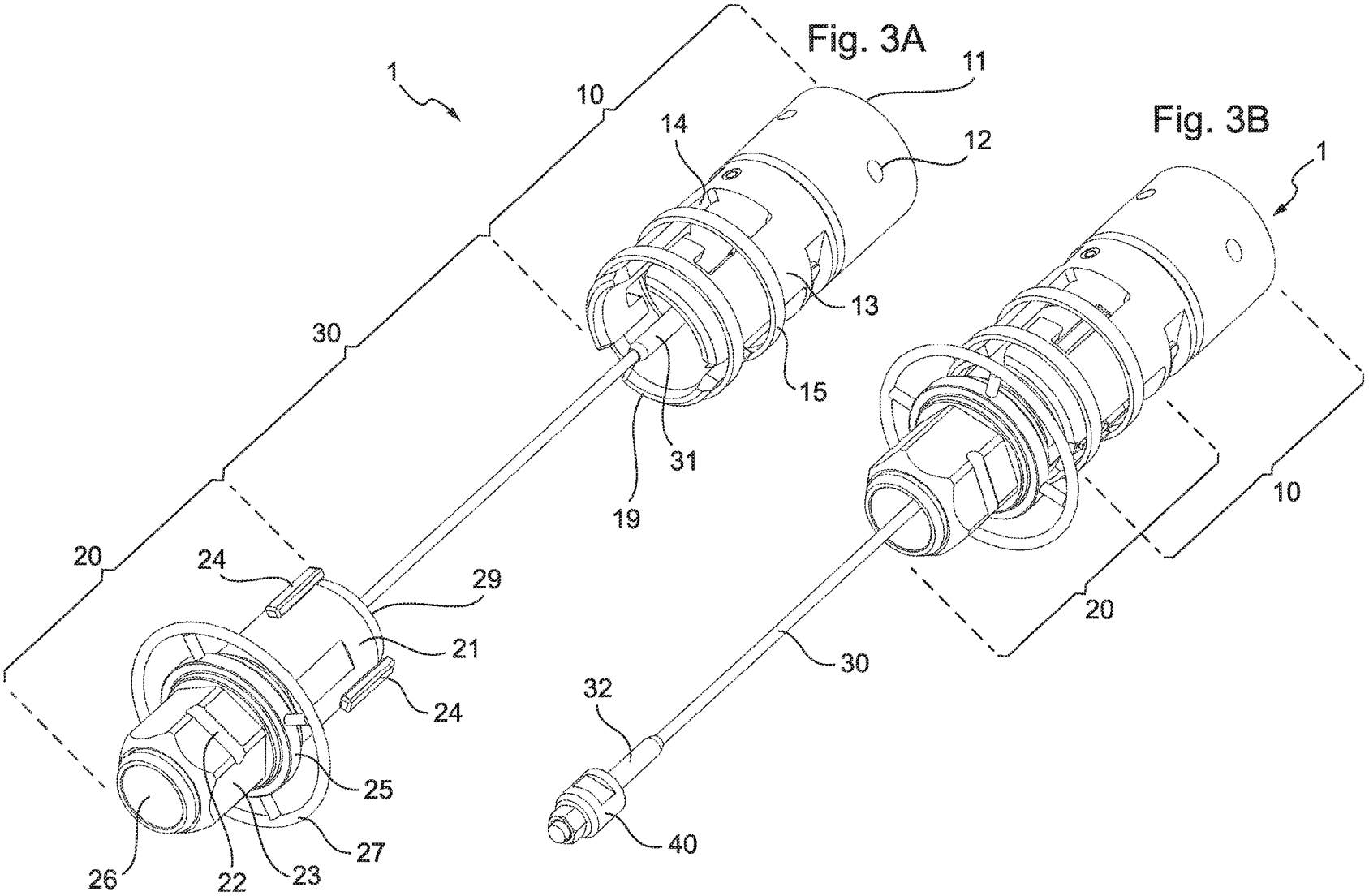
FIGS. 3*a* and 3*b* are perspective views of the moving and assembly device shown in extended disengaged configuration (FIG. 3*a*) and in contracted completely engaged configuration (FIG. 3*b*)

Starting from the intermediate decoupled condition of the device 1, it is possible to bring the male lower joint 20 closer to the female upper joint 10 until the upper male coupler 21 of the male lower joint 20 inserts into the female lower recess 13 of the female upper joint 10 so as to reach the engaged contracted and partially locked condition visible in FIG. 2A. In order to allow this insertion it is necessary for the two joints to be angularly phased so that the strip 24 (or the strips) of the male lower joint 20 can insert into the bayonet opening 14 (or into the openings).

Each of the bayonet openings 14 can be divided into three portions or areas, respectively indicated as 14A, 14B, 14C, which are indicated in FIG. 2A. The first portion 14A consists of a channel arranged parallel to the longitudinal axis of the coupler, said channel has a width sufficiently greater than the width of the strip 24 so as to allow the passage thereof and has a length greater than the length of the strip 24, preferably at least double. The second portion 14B extends along the circumference of the upper coupler in a tangential direction and has a height slightly greater than the height of the strip 24 so that it can slide therein in a tangential direction, thus allowing a relative rotation between the female upper joint 10 and the male lower joint 20 when they are in partially coupled contracted condition. In particular, the portion 14B allows the upper male coupler 21 of the male lower joint 20 to rotate inside the female lower recess 13 of the female upper joint 10, with a rotation about the longitudinal axis of the female upper joint 10. During such a rotation, the strip 24 moves from the side corresponding to the entry area 14A up to the opposite side corresponding to the coupling area 14C. In particular the portion 14B of the bayonet opening 14 extends so that it is necessary to rotate the coupler of the female upper joint 10 in the digging direction in order to move the strip from the entry area 14A to the coupling area 14C. The term digging direction means the direction in which the auger rotates to screw into and advance in the ground during the digging execution. The third portion 14C of the bayonet opening 14 consists of a longitudinal channel of shorter length than the strip 24 and that extends towards the lower part of the joint, so that the strip 24, in order to get into the channel 14C, must translate in the opposite direction with respect to the direction necessary to get into the channel 14A.

Starting from the intermediate decoupled condition of the device 1, i.e. if the strips 24 are phased with the openings 14 and the two joints 10 and 20 are axially brought close to one another, once the strips 24 have been inserted into the portion 14A of the respective bayonet openings, the two joints can slide approaching one another until the axial abutment surface 19 of the female upper joint 10 gets in contact with the corresponding axial abutment surface 29 of the male lower joint 20. Such surfaces are arranged on planes perpendicular to the longitudinal axis of the respective joints 10 and 20. Once the axial abutment surfaces 19 and 29 are in contact, as it can be seen in FIG. 2A, it is possible to transmit an axial thrust from the female upper joint 10 to the male lower joint 20 or vice-versa. Such a force will make the device 1 stay in contracted position. If from this condition a rotation is imposed in the digging direction, the strip 24 slides tangentially for the entire portion 14B of the bayonet opening until it goes into abutment. At this point, by applying a pull upwards to the upper joint, the strip 24 inserts into the portion 14C of the bayonet opening as it can be seen in FIG. 2B. In this condition, the moving and assembly device 1 is in the engaged and locked contracted configuration as it can be seen in FIG. 2B. The strip 24 results to be locked both in rotation and in sliding downwards inside the channel 14C. Therefore, in the completely coupled contracted condition, the device 1 allows a pulling force and/or a torque applied to the female upper joint 10 by the rotary head 4 to be transmitted to the male lower joint 20 and, consequently, to what is rigidly connected to such a male lower joint 20. When the male lower joint 20 and the female upper joint 10 are engaged in one another in contracted and locked condition, the bayonet openings 14 and the strips 24 are suitably sized to withstand the entire torque that can be delivered by the driving tube of the rotary table to which they can be fixed to withstand all of the pulling and pushing forces exertable by the moving system of the rotary head along the tower and are sized so as to be able to transmit such torques or forces to the excavation battery made of augers and bit or of smooth rods.

The use of the moving and assembly device 1 as described above significantly facilitates the assembly and/or disassembly maneuvers of the battery 50 of digging segments 51, 52 like augers or rods. According to the method for using the device 1, the new assembly procedure of the battery of augers 50 differs from the procedures used in the prior art and previously described and comprises the following steps:

a) With reference to FIG. 4A, initially the device 1 is in the decoupled configuration (previously described with reference to FIG. 1B) and can be positioned on the ground close to the digging machine 2 or it can be arranged on the ground in a generic point of the worksite and subsequently the machine 2 approaches it. In such a configuration the rotary head 4 and the driving tube 5 are lowered as much as possible along the guide tower 3 of the machine 2, so that the lower joint 6 of the tube reaches a height with respect to the ground that allows the worksite workers to reach the joint 6 without having to use ladders or platforms. With the aid of the service cable 8 of the machine the female upper joint 10 is lifted and positioned vertically under the driving tube 5 so as to make them coaxial. By lifting the female upper joint 10 further, the lower joint 6 of the tube (generally male) inserts into the corresponding upper recess 11 of the female upper joint 10.

Figure 4B:
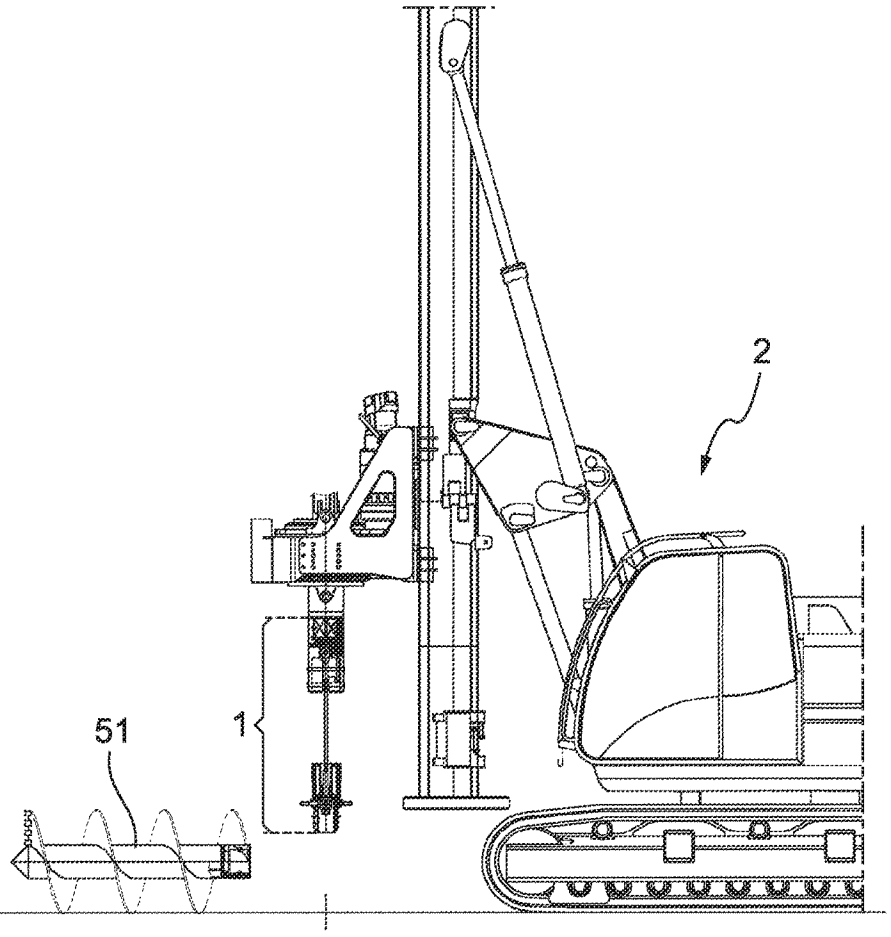
FIGS. 4*a* and 4*b* show the moving and assembly device in condition ready to be fixed or installed on the digging machine (FIG. 4*a*) and the step in which the digging machine, with the moving and assembly device installed thereon, prepares to be loaded with the bit of an auger (FIG. 4*b*)
Figure 4A:
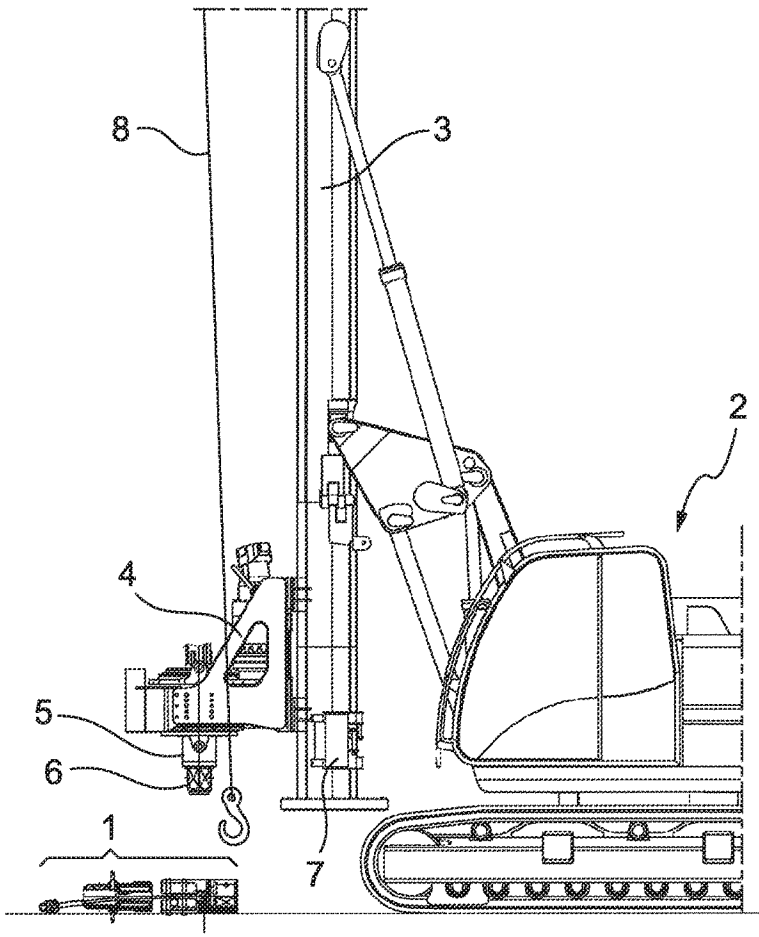
Figure 5D:
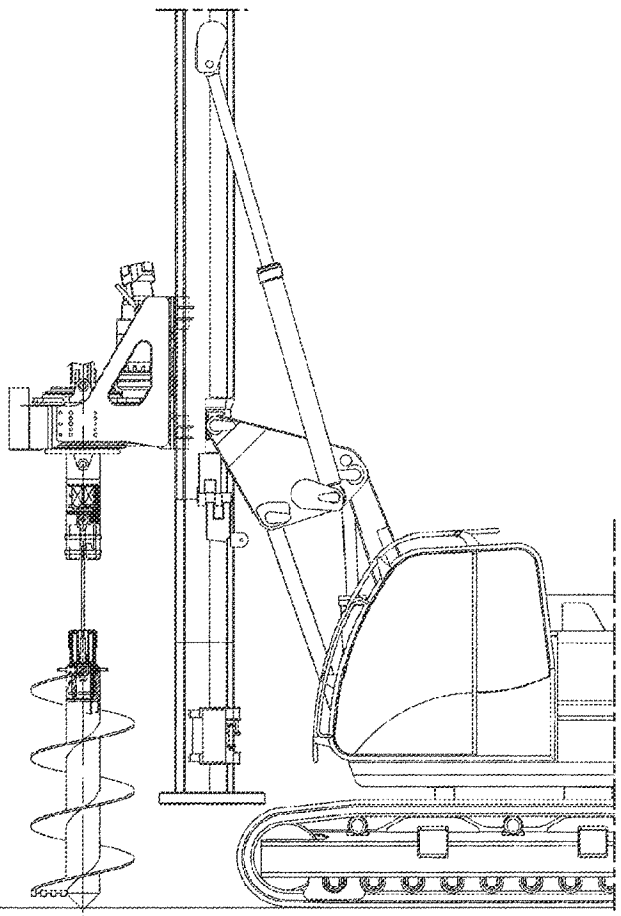
FIGS. 5*a*-5*d* show the connection steps of the moving and assembly device at an auger bit segment (FIG. 5*a*) and the steps of lifting and positioning such a bit segment (FIG. 5*b*-5*d*)
Figure 5C:
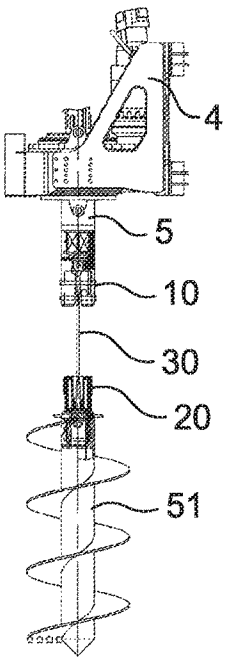
Figure 5B:
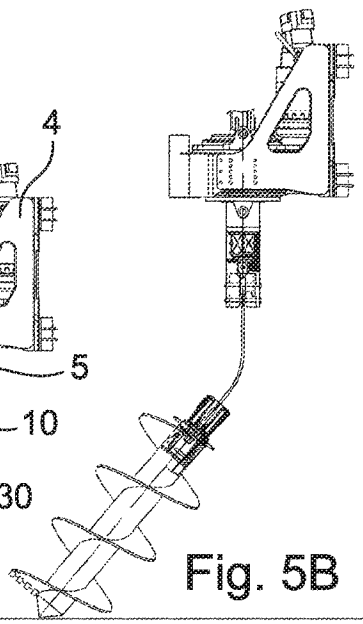
Figure 5A:
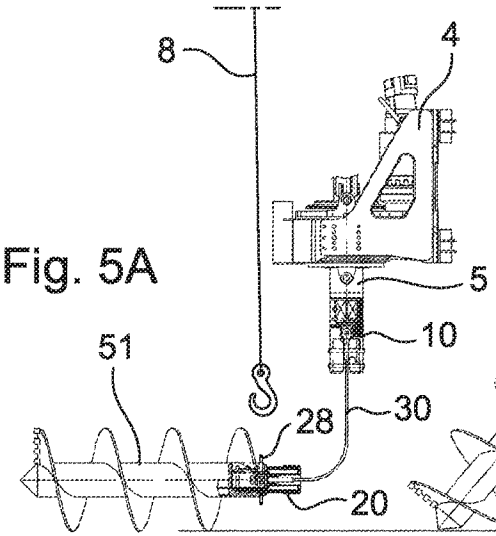
Figures 6A, 6B, 6C, 6D:
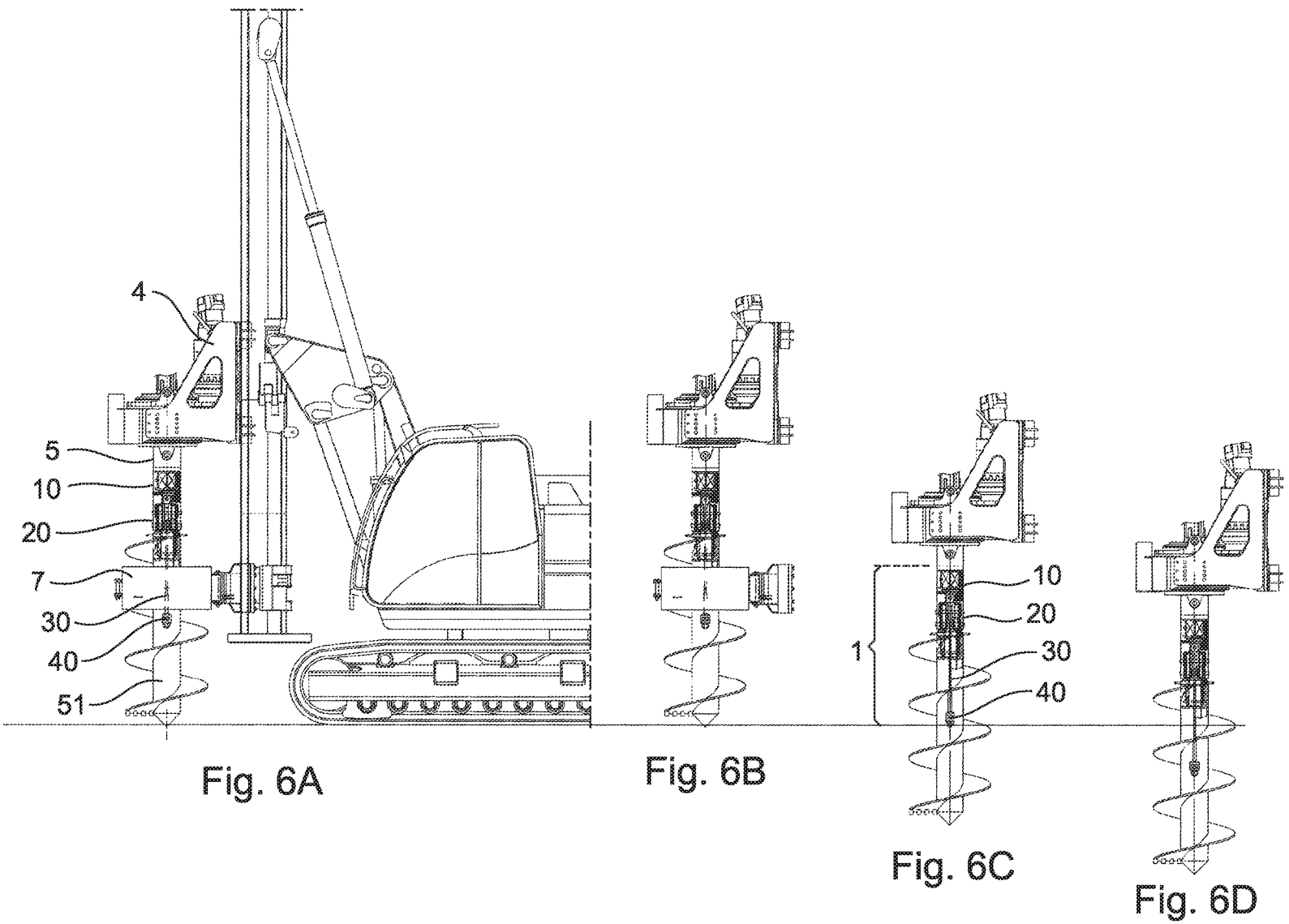
FIGS. 6*a*-6*d* show the steps of driving the auger bit segment into the ground with the moving and assembly device in contracted configuration of FIG. 3*b* completely coupled mounted between the auger bit segment and the driving tube of the rotary head.
Figures 7A, 7B:
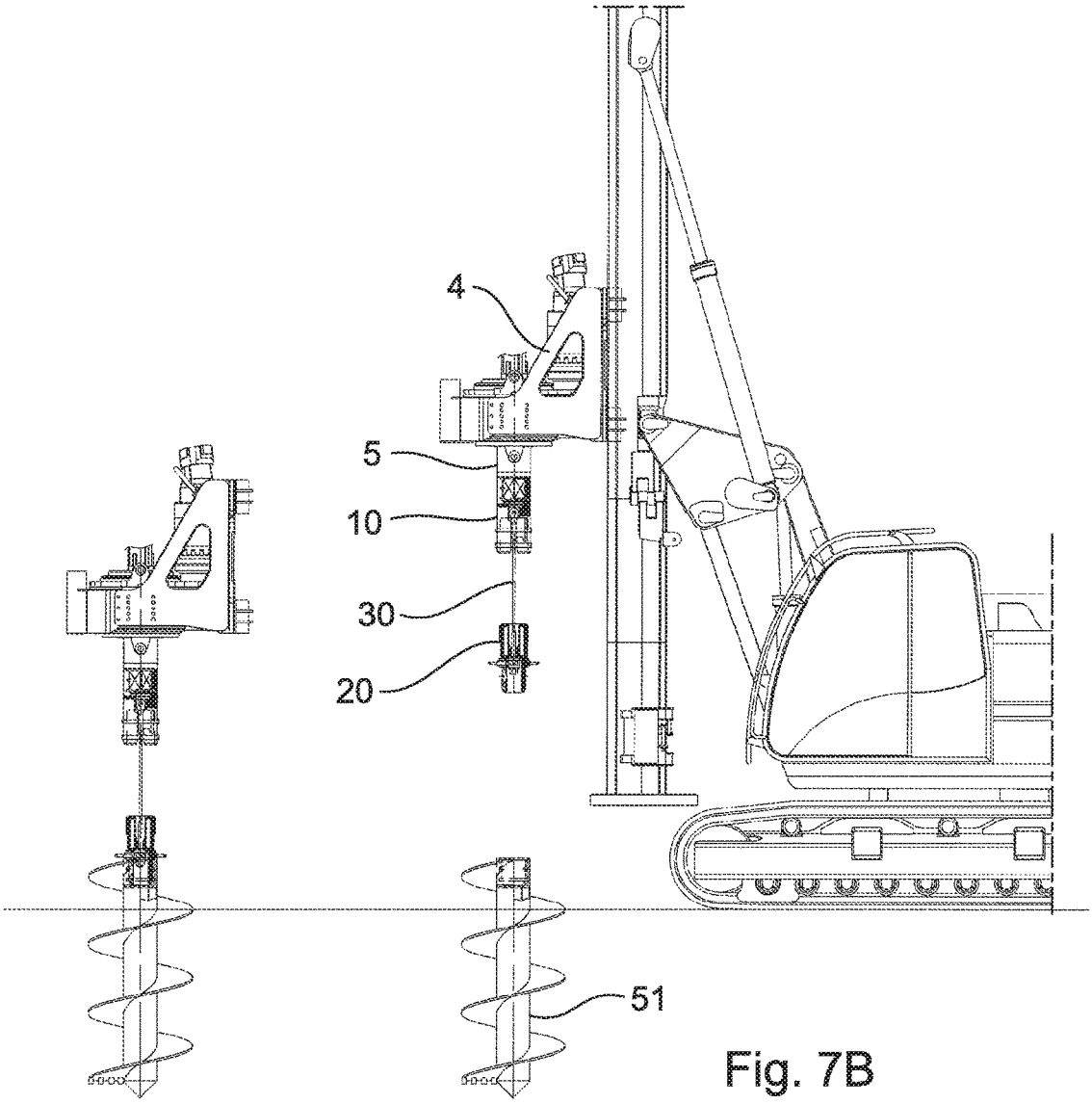
FIGS. 7*a*-7*b* show the steps of disconnecting the moving and assembly device from the auger bit segment.

Once the lower joint 6 of the tube have been engaged in the recess 11 of the female upper joint 10, such two elements are fixed to one another with transverse pegs that pass through the seats 12. The moving and assembly device 1 is thus made integral to the rotary head 4, anyway in a removable manner through subsequent extraction of the pegs. In particular, the female upper joint 10 results integral to the tube 5 (and to the rotary head 4) so that pulling and pushing forces and torque can be mutually transmitted. During this connection step of the device 1 to the machine 2, and more specifically of the female upper joint 10 to the tube 6, it is possible for the male lower joint 20 to remain rested on the ground if the flexible element 30 is sufficiently long. Alternatively, when the device 1 is disconnected from the machine, it is possible to deposit it in a gantry support or tripod support that keeps it oriented with the longitudinal axis arranged vertically, so that it is easier and quicker to perform the engagement step of the joint 6 of the tube with the recess 11 of the joint 10, which will both be already parallel. If present, the openable guides 7 of the machine that are fixed to the base of the antenna 3 are left in the open configuration like in FIG. 4A.

b) With reference to FIG. 4B, once the moving and assembly device 1 has been connected to the digging machine 2, the rotary head 4 is lifted by making it slide upwards on the tower and at the same time the sliding of the flexible element 30 inside the male lower joint 20 is imposed until the ballasted stop element 40 gets in contact with the necking 27 causing the male lower joint 20 itself to be driven and lifted with respect to the ground. At this point, due to the effect of its own weight, the moving and assembly device 1 arranges in the completely extended decoupled configuration. The male lower joint 20 is kept at a height from the ground that can easily be reached by workers on the ground. Then the first digging segment 51 of the battery 50 that needs to be loaded to make up the battery itself is brought close to the machine 2. In the case of a battery of augers, the first element to be loaded is the bit 51 that typically has a length of about two meters. The bit 51 can be left lying on the ground, at a distance reachable by the male lower joint 20 and by the flexible element 30.

c) The lower joint 20 is then brought close to the segment 51 as shown by FIG. 5A, possibly with the aid of the service cable 8 of the machine that hooks to the male lower joint 20 of the device 1 at a handle or ring 28. The worksite workers operating on the ground grip the male lower joint 20, preferably through the handle or grip ring 28, and orients it so that the male lower coupler 23 be coaxial and angularly phased with respect to the female recess of the upper joint of the auger segment 51. Thanks to the flexibility of the flexible element 30 of the moving device 1, it is possible to generate transverse and angular offsetting between the male lower joint 20 and the female upper joint 10 so as to be able to orient the male lower joint 20 in a suitable manner to connect it quicker to the segment 51 to be moved. In particular, the male lower joint 20 can take up a configuration in which its longitudinal axis is tilted with respect to the longitudinal axis of the female upper joint 10 with inclinations that can even exceed ninety degrees, as it can be seen in FIG. 5A. Transverse offsetting is also permitted, for example by keeping the two longitudinal axes of the upper coupler and of the lower coupler parallel, but not coaxial. Combinations of transverse and angular offsetting are also possible. Moreover, the male lower joint 20 can also rotate about the longitudinal axis of the flexible element, since the flexible element 30 can rotate in the inner duct 26 and in the necking 27 and in the same way the ballasted stop element 40, having a circular shape and suitable diameter, can rotate inside the duct 26. Once the male lower joint 20 has been axially aligned and angularly phased with the segment 51, the male lower coupler 23 is then inserted in the female joint present at the top of the bit 51. Then the transverse pegs are inserted into the seats 22 so as to securely lock the male lower joint 20 to the bit 51, making them integral as it can be seen in FIG. 5A. In this configuration the bit 51 results to be indirectly constrained to the tube 5 and to the rotary head 4. Then the service cable 8 is unhooked from the male lower joint 20 so as to release it. The advantage provided by the device 1 during this step is that of being able to connect the tube to the bit 51 even if this is not axially aligned with the tube itself, thus eliminates the need to lift the bit 51 with auxiliary means such as a crane and also eliminates the need to vertically orient the bit.

d) The rotary head 4 is lifted along the tower 3 (which for the sake of simplicity is not shown in FIGS. 5A-5C), so that the bit 51 is lifted from an end like in FIG. 5B until it detaches from the ground. In this raised condition, visible in FIG. 5C, the bit 51 spontaneously arranges in a substantially vertical position and will have its longitudinal axis coaxial to the tube and therefore coaxial to the digging axis.

e) The rotary head 4 is lowered along the tower 3 until the lower part of the bit 51 is rested on the ground, keeping the auger vertical and keeping the flexible element 30 slightly tensioned as shown in FIG. 5D.

f) The openable guides 7, if present on the machine, are closed so that they wrap around the bit 51 and can prevent deviations of the bit with respect to the vertical. Openable guides or guide elements can also be present in the case in which smooth rods are used. The rotary head 4 is lowered until the male upper joint 20 gets in contact with the female lower joint 10. During manoeuvring the flexible element 30, thanks to the counterweight effect of the ballasted stop element 40, descends in the duct present in the shaft of the bit 51 and does not create impediments to the connection manoeuvring of the two joints. The element 40, thanks to its diameter suitable for sliding in the duct of the bit 51, goes in a position below the male lower joint 20. The strips 24 of the lower coupler 20 will get in contact with the female upper joint 10.

g) A small rotation of the female upper joint 10 is carried out (through rotation of the tube 5) until the bayonet openings 14 of the lower coupler 13 of the female upper joint 10 angularly phase with the strips 24 of the male coupler 21 of the male lower joint 20. Once they have been phased, the strips 24 can slide inside the bayonet openings 14 (in particular in the portion 14A of the openings) simultaneously allowing a relative axial approach movement between the female upper joint 10 and the male lower joint 20 until they reach the engaged contracted configuration visible in FIGS. 6A and 6B and already described in detail earlier with reference to FIG. 1C. In this condition the female upper joint 10 can transmit torque (thanks to the fact that the strips 24 after a small translation in the area 14B of the openings go in mechanical abutment on the edge of the coupling area 14C) and thrust (thanks to the fact that the axial abutment faces 19 and 29 come in contact) to the male lower joint 20.

h) At this point, the rotary head 4 is lowered along the antenna 3 (not shown for the sake of simplicity in the images 6B-6C) pushing it downwards and simultaneously the tube 5 is rotated in the digging direction. Thanks to the moving and assembly device 1 the torque and the thrust are thus transferred from the tube 5 (i.e. from the machine 2) to the bit 51. Under the effect of these forces the bit 51 starts to excavate the ground like in FIG. 6C and proceeds until the bit is mostly inserted in the ground (about three quarters of its length as it can be seen in FIG. 6D) so that it is firmly locked in the ground. The strips 24 of the lower coupler and the bayonet openings of the upper coupler are suitably sized to withstand all of the torque and the thrust that can be delivered by the rotary head 4, thus being able to transmit the same forces that the joints of the tube and of the bit would exchange if they were connected to one another directly without the interposition of the device 1.

i) When the bit is mostly embedded, a counter-rotation of the tube 5 is carried out, i.e. a rotation in the opposite direction to the digging direction so that the female upper joint 10 integral to the tube 6 carries out a small relative rotation with respect to the male lower joint 20 that, on the other hand, remains still since it is integral with the auger that is held by the friction with the ground. This small counter-rotation allows the strips 24 to go into phase with the channel 14A of the bayonet openings, i.e. in the position that allows the strips to slide with respect to the female upper joint 10. The device 1 is therefore in the condition already described with reference to FIG. 2A. The rotary head is lifted so that the female upper joint 10, rising, withdraws from the male lower joint 20 taking the device 1 into a partially extended and decoupled condition (corresponding to the condition described for FIG. 1B). The rotary head 4 is continued to be lifted along the tower 3 so that the female upper joint 10 moves away from the lower one 20 while the flexible element 30 slides inside the male lower joint 20. As it can be seen in FIG. 7A, this proceeds until the ballasted stop element 40 goes in abutment in the suitable necking 27 made inside the male lower joint 20. At this point the worksite workers operating on the ground provide for withdrawing the pins locking the male lower joint 20 to the upper joint of the bit 51 from the seats 22.

j) Starting from the condition of FIG. 7A and lifting the rotary head 4 further, a pull is applied on the flexible element 30 that is then transmitted through the element 40 to the male lower coupler 20, which will withdraw from the joint of the bit 51 remaining hung to the flexible element 30 as it can be seen in FIG. 7B. Since the male lower joint 20 is suspended from the flexible element 30, there is no danger that the male joint 20 falls once it is decoupled from the bit and, therefore, there is no danger for the worksite workers. Moreover, workers are relieved of the task of having to support the weight of the lower male joint 20, and by gripping it through the handle 28 can orient it as desired with the minimum effort. The moving and assembly device 1 is therefore available to be able to move a new auger segment to be added to the battery 50, using the same method described in points a-g of the previous list. Since the bit 51 is mostly planted in the ground, it supports itself and is kept vertical thanks to the friction with the ground. It is thus possible to connect another auger segment 52 above the but segment 51 by coupling the respective joints without the need to hold or guide the bit 51 any further.

Figures 8A, 8B, 8C, 8D, 8E:
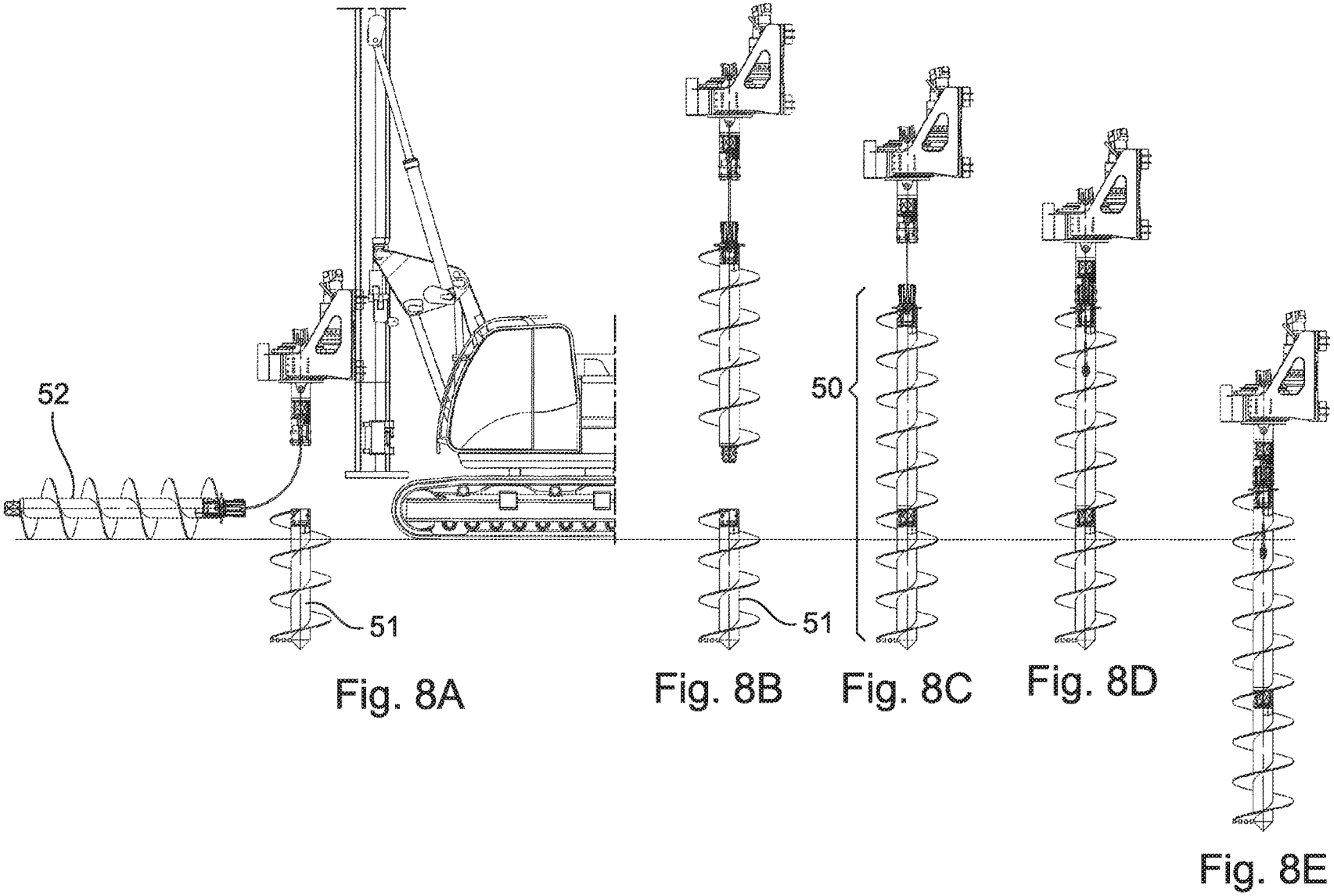
FIGS. 8*a*-8*e* show the steps of connecting the moving and assembly device to an auger segment to be added to the battery of segment being assembled (FIG. 8*a*) and the steps of lifting and connecting the auger segment to the bit segment or to the excavation battery part already made up (FIG. 8*b*-8*d*) and the step of driving the bit segment and the auger segment (FIG. 8*e*) just associated into the ground.
Figures 9A, 9B, 9C, 9D, 9E, 9F:
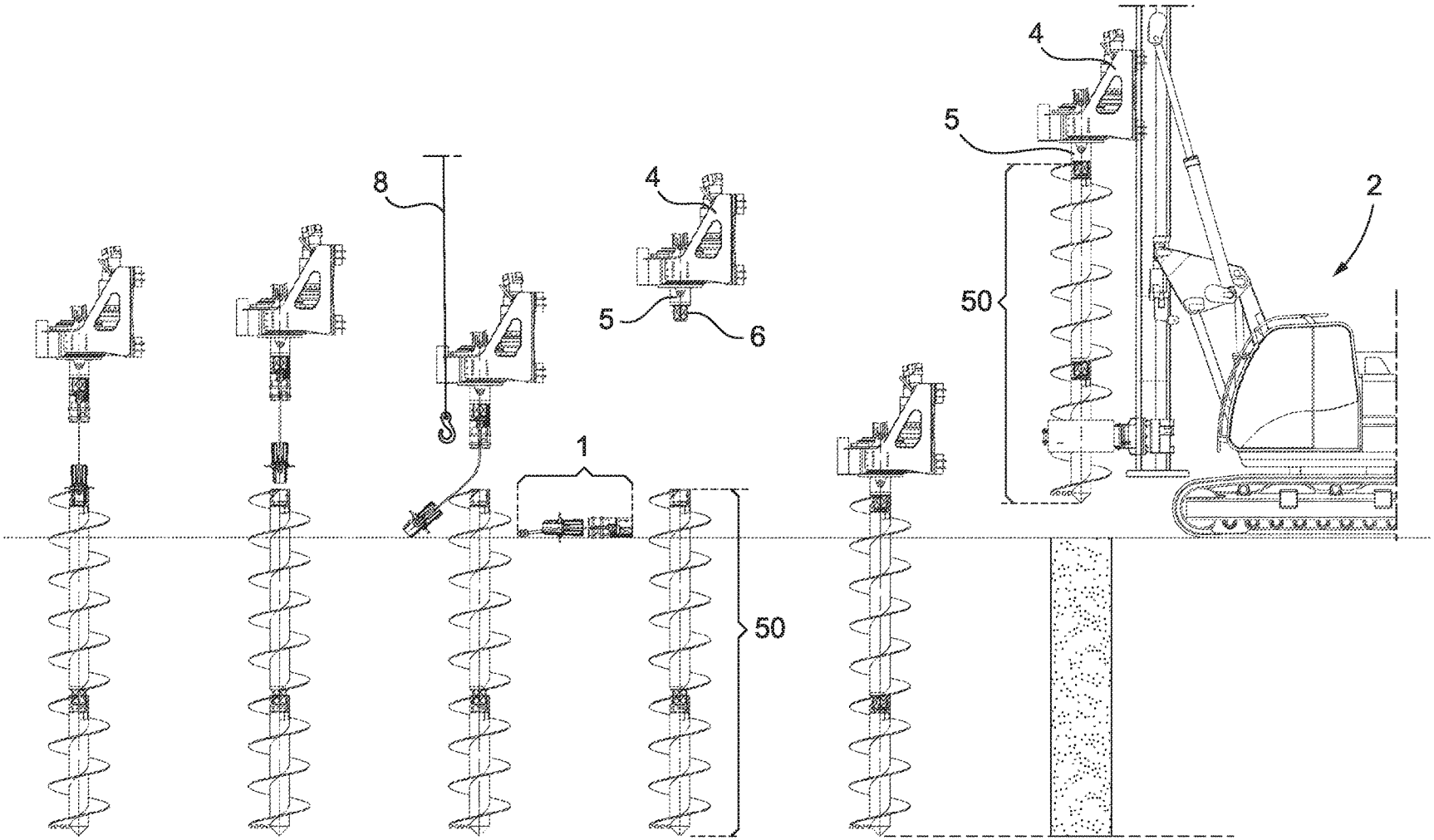
FIGS. 9*a*-9*b* show the steps for disconnecting the moving and assembly device from the auger (FIG. 9*a*-9*b*) and the steps of disconnecting the device from the digging machine (FIG. 9*c*-9*d*) and the step of connecting the tube of the rotary head to the complete excavation battery (FIG. 9*e*-9*f*)

FIGS. 8A to 8E and FIGS. 9A-9C illustrate the sequence of operations for mounting an auger element 52 above the bit 51 already driven into the ground to make up the battery of augers 50. It also includes the step of driving in the auger element 52 for most of its length, preferably to a useful level so as to be able to load a further auger element 52 on the one already driven into the ground. Starting from the condition of FIG. 7A, with the moving and assembly device 1 in completely extended condition with the couplers decoupled from one another and fixed to the tube 5 of the machine 2 ready for use, the steps can be summarised thus:

a) Through movement of the rotary head 4 on the antenna 3, the male lower joint 20 is kept at a height from the ground that can easily be reached by the workers operating on the ground. Then the auger element 52 that needs to be loaded to make up the battery 50 is brought close to the machine 2. The auger element 52 (or rod) can be left lying on the ground, at a distance reachable by the male lower joint 20 and by the flexible element 30.

b) The worker on the ground orients the male lower joint 20, possibly with the aid of the service cable 8, and when this is axially aligned and angularly phased, the joint 23 of the male lower joint 20 is then inserted into the female joint present on top of the auger segment 52. Then the transverse pegs are inserted into the seats 22 so as to securely lock the male lower joint 20 to the element 52 making them integral as it can be seen in FIG. 8A. The auger element 52 results to be indirectly constrained to the tube 5 and to the rotary head 4 through the device 1.

c) By lifting the rotary head 4 along the tower 3 (which for the sake of simplicity is not shown in FIGS. 8B-8E), the auger element 52 is lifted until it detaches from the ground arranged substantially vertical with its longitudinal axis coaxial to the tube 5 and therefore coaxial to the digging axis.

d) The rotary head 4 is lowered until the lower joint (of the known prismatic type) of the element to be added 52 engages in the upper joint 51 (of the known prismatic type) of the part of battery 50 already made up as it can be seen in FIG. 8C. Only the first time that this step is carried out will the already made up part of the battery 50 consist of only the bit 51. The joining area between the already made up battery 50 and the new added element 52 will be at a height reachable from the ground by the worksite workers that provide for inserting the transverse pegs in order to axially fix the added element 52 to the already made up battery 50.

e) The rotary head 4 is lowered and small rotations are carried out so as to phase the female upper joint 10 with the male lower joint 20. The descent continues engaging the two joints 10 and 20 with one another until the moving and assembly device is brought to the engaged and partially locked condition. The ballasted stop element 40, sliding inside the duct of the shaft of the auger element 52, goes to a lower height than the lower joint 20, without however coming out of the lower edge of the auger element 52. A small rotation of the tube is carried out in the digging direction to translate the strips 24 tangentially and to take the device 1 to the engaged and locked contracted condition as it can be seen in FIG. 8D.

f) The rotary head 4 is then pushed downwards and the tube 5 is rotated so as to make the excavation battery 50 penetrate almost completely into the ground but leaving the upper joint of the last auger element 52 loaded jutting out. This condition is shown in FIG. 8E.

g) The rotary head 4 is lifted slightly and simultaneously the upper joint 10 is also lifted until the strips 24 are disengaged from the area 14C of the recess 14, then a small counter-rotation is carried out in the opposite direction to digging in order to take the strips 24 into the area 14A of the bayonet opening 14 and to arrange the device 1 like in the partially locked engaged condition of FIG. 2A. From this condition, by lifting the rotary head 4 the upper joint 10 is withdrawn, disengaging it from the lower one 20 until the stop element 40 abuts in the necking 27 and the flexible element 30 tensions as shown in FIG. 9A, in which the device 1 is in the extended disengaged condition.

h) The worksite workers operating on the ground withdraws the pegs or pins from the recesses 22 of the lower joint so as to release it from the excavation battery 50, then by lifting the rotary head 4 the device 1 is decoupled from the battery 50 made up as shown in FIG. 9B. Once the condition of FIG. 9B has been reached, if it is wished to add one or more further auger segments 52 it is possible to repeat all of the steps 8A to 9B for each segment 52 that it is wished to add until the complete battery of digging segments 50 is obtained.

i) Once the entire excavation battery 50 has been assembled in the number of useful segments, it is almost entirely inserted in the ground, apart from the upper joint of the last segment mounted. At this point it is possible to proceed dismounting the moving device 1 from the machine 2. Starting from the condition of FIG. 9B, thanks to the deformability of the flexible element 30 the male lower joint 20 is moved laterally so as to offset it with respect to the digging axis, operating manually or with the aid of the service cable 8 of the machine. By lowering the rotary head 4 the male lower joint 20 is rested on the ground and the female upper joint 10 is taken to a height reachable by the worksite workers keeping their feet on the ground. Said condition is visible in FIG. 9C.

j) Through the service cable 8 the female upper joint 10 is hooked so as to hold it. The workers on the ground provide for withdrawing from the seats 12 the pegs or pins locking the female upper joint 10 to the joint 6 of the driving tube 5. By releasing the cable 8 the female upper joint 10 is withdrawn from the tube so as to completely disconnect the moving device 1 from the machine 2. The device 1 for moving and assembling augers can thus be rested on the ground as it can be seen in FIG. 9D to then be transported in the warehouse. At this point, since the dismounting of the device 1 has not required any movement of the machine, the driving tube 5 will still be coaxial to the battery of drilling augers 50.

k) By lowering the rotary head 4 and imposing small rotations of the tube 5, the joint 6 of the tube engages in the upper joint of the battery of augers 50, in particular of the upper auger segment 52, which will be slightly above the landscape plane. The worksite workers provide for inserting the pegs to axially fix the tube 5 to the battery 50. In this condition, visible in FIG. 9E, the excavation battery 50, made of the bit 51 and of multiple intermediate segments 52, results to be operatively connected to the digging machine 2. In particular, the battery 50 is also already driven into the ground, and therefore it is already possible to pump a cement mixture through the inner duct of the shaft of each element of the battery 50, so as to fill in the excavation while rising to the surface with the auger. When the excavation battery 50 is completely extracted from the ground, the first foundation pile will also already have been made.

Figures 10A, 10B, 10C, 10D, 10E, 10F, 10G, 10H, 10I:
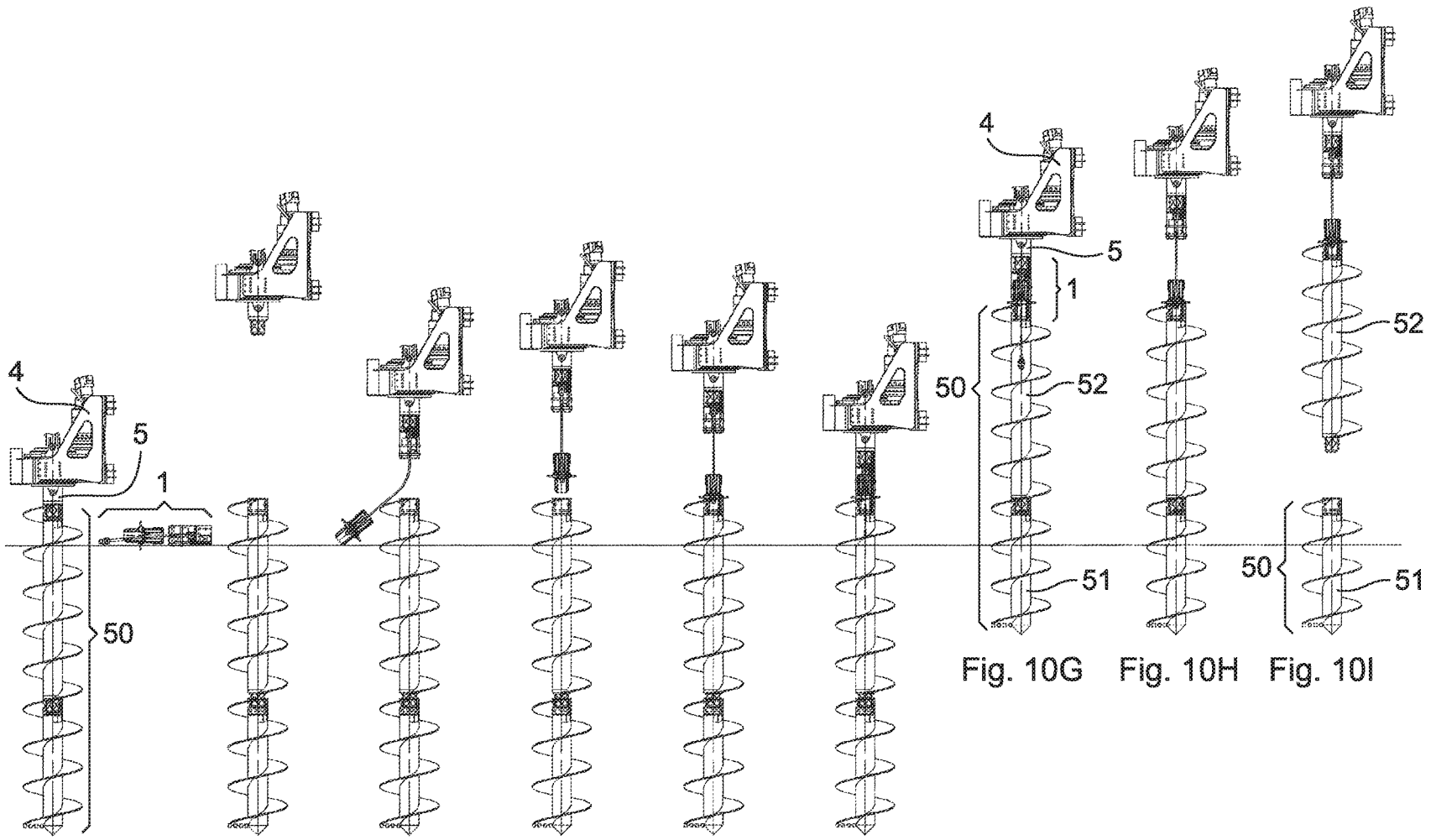
FIGS. 10*a*-10*i* show the steps of use of the moving and assembly device for disassembling the excavation battery at the end of the works by dismounting it into its single digging segments.

The sequence of FIGS. 10A-10I shows the procedure for disassembling the excavation battery 50 at the end of the excavations using the moving and assembly device 1 to progressively separate the single elements that make up the battery 50. For reasons of space and clarity the machine 2 is not represented in these figures, but it is clear that the visible rotary head 4 is connected to the guide tower of the machine 2 and slides on the tower during the various steps of the sequence 10A-10I.

a) As shown in FIG. 10A, in order to be able to disassemble the battery 50 it is necessary to plant it into the ground while it is still directly connected to the tube 5 without interposition of the device 1. The upper joint of the battery is left outside of the landscape plane.

b) As shown in FIG. 10B, the moving and assembly device 1 is brought close to the battery 50, possibly laying it on the ground. The workers on the ground withdraws the transverse pegs in the tube 5 and, lifting the rotary head 4, disengages it from the battery. The battery remains still and vertical in the excavation due to friction.

c) As shown in FIG. 10C, the rotary head 4 is lowered and, with the aid of the service cable 8, the female upper joint 10 is connected to the tube 6 through the relative pegs.

d) As shown in FIG. 10D, the rotary head 4 is lifted until the male lower joint 20 is lifted and the device is arranged in the disengaged extended condition with the female and male joints 10, 20 arranged on the digging axis and on the longitudinal axis of the battery.

e) As shown in FIG. 10E, the rotary head 4 is lowered and, operating on the ground, the male lower joint 20 is oriented so that it inserts into the upper joint of the battery 50. The worker on the ground inserts the transverse pegs making the lower joint integral with the battery 50.

f) As shown in FIG. 10F, the rotary head 4 is lowered and small rotations of the tube are carried out until the upper joint is engaged in the lower joint so that the strips 24 insert into the bayonet openings. With a small counter-rotation the strips are taken into the recess 14C and the device 1 is in the contracted and completely locked engaged condition. The ballasted stop element 40 and the lower part of the flexible element 30 slide inside the duct of the excavation battery and go to a lower height with respect to the male lower joint 20.

g) As shown in FIG. 10G, the rotary head is lifted by applying an extraction pull on the excavation battery and possibly keeping the excavation battery 50 in rotation. The moving and assembly device 1 transmits the entire torque and the pull from the tube 5 to the battery 50. The rotary head 4 is lifted until the entire upper segment of the battery 50, i.e. the auger segment 52, and at least the upper joint of the underlying element (in this case the bit 51) are extracted.

h) As shown in FIG. 10H, a counter-rotation of the tube 5 is carried out while it applies a traction to the battery 50, so that the strips 24 disengage from the area 14C of the bayonet and there is a relative rotation between female upper joint 10 and male lower joint 20. Once the bayonet coupling of the joints has disengaged, the two joints withdraw and continuing to lift the rotary head 4 the device 1 goes into the extended disengaged condition.

i) As shown in FIG. 10I, the workers on the ground remove the transverse pegs from the joint between the segment 52 that is wished to be disassembled and the rest of the battery 50 (in this case from the bit 51). By lifting the rotary head 4 the segment 52 is withdrawn separating it from the rest of the excavation battery and it is taken into a condition suspended and coaxial to the digging axis. Through the service cable 8 the suspended segment can be offset from the digging axis and descending with the rotary head 4 it can be rested on the ground. At this point it can be completely laid on the ground and the workers will provide for removing the transverse pegs to disconnect the male lower joint 20 from the unloaded auger segment 52. At this point, the disassembled segment 52 is completely disconnected from the machine 2, from the device 1, and from the battery 50 and it can be transported to storage.

j) In order to disassemble further segments of the battery the steps of FIGS. 10D-10I are repeated for each element to be disassembled.

Thanks to the present invention a series of important advantages are thus achieved, some of which will now be listed:

The device or auxiliary apparatus 1 is fixed to the driving tube 5 only once for the entire assembly or disassembly process of the battery of augers 50. Namely, whenever an auger segment must be added, the female upper joint 10 always remains fixed to the tube without dismounting it each time. The lower joint is connected and disconnected each time to the new segment to be moved, but this operation is very simple since the weight of the lower joint is supported by the flexible element 30.

The loading maneuvers of the digging segments 51, 52 of the battery 50 through the device 1 do not require external support or lifting means, such as service cranes or aerial platforms or ladders.

The device 1, by its configuration, is capable of moving an auger segment 52 irrespective of the angle taken up by the joint of the segment and its inclination with respect to the ground, provided that it falls within the range reachable by the length of the flexible cable 30. Therefore, it is not necessary to have lifting means that manage to grip the segment to be loaded and that position it arranged vertically below the rotary head. This maneuver would be difficult even using the winch and the service cable 8 of the machine, since the bulk of the rotary head 4 hinders the positions reachable by the cable, which cannot get very close to the axis of the tube, i.e. to the digging axis.

The male lower joint 20 can be moved or oriented using the service cable 8 of the machine 2 itself to take it close to the joint present on the digging segment to be moved and loaded; therefore, the worksite workers do not have to lift heavy weights.

The flexible element 30 that connects the two female and male joints 10, 20 has a high load capacity and allows the suspended load to be maneuverd in total safety, also allowing possible translations of the machine with segments connected to the device 1 and kept suspended.

The ballasted stop element 40 present in the tool favours the full descent of the cable in the cement duct present inside the shaft of the pieces of auger, so as not to create a hindrance to the bayonet connection system present in the two couplers (upper and lower).

The female and male joints 10, 20 are sized to withstand torque, thrust and extraction in the maximum values delivered by the machine.

The first excavation carried out with the device 1 interposed between the tube and the excavation battery, commonly intended for making up the battery, to all effects can be used to cast the cement during the lifting of the battery thus obtaining the first pile. Therefore, it is not necessary to carry out a "dedicated" excavation only for the assembly of the battery, but such an assembly can be carried out directly in the position in which the first pile has to be made, so as to save time and reduce costs.

All of the maneuvers that the workers need to make to assemble and disassemble the excavation battery 50, none excluded, are carried out directly from ground level.

The operative sequence that constitutes the method of use of the device 1 allows the workers to maneuver in complete safety the elements that combine to make up the battery. The flexible element 30 that from time to time lifts the segment to be mounted is constrained at the top (in the upper joint) at a point that lies on the axis of the auger, i.e. on the digging axis, to the great benefit of maneuvers precision. The weight itself of the element lifted due to the "plumb line" effect tends to spontaneously arrange the element in the position correctly oriented for mounting or connection to the battery. Said flexible element 30 and the members that connect it to the couplers 10 and 20 are amply sized to support the entire weight of the complete made up battery and not only the weight of the single piece. All of the approach, phasing and driving/extraction maneuvers of the pegs are carried out directly from ground level.

Of course, the moving and assembly device 1 of the present invention thus conceived can undergo numerous modifications and variants, all of which are covered by the same inventive concept; moreover, all of the details can be replaced by technically equivalent elements.

Among the most important variants it is possible to quote the following list:

Totally equivalent embodiments are possible in which the male and female joints are exchanged with respect to the embodiment described and visible in the figures. For example, the tube 5 can have a female lower joint and the bit 51 can have a male upper joint. In this case, the device 1 will have a male upper joint whereas the lower joint will have a female configuration. In the same way, it is possible to make a male joint equipped with strips on the upper joint and a joint equipped with bayonet openings on the lower joint.

It can be hypothesised to make up the entire, or at least a part, of the excavation battery 50 keeping all or some elements 51, 52 laid on the ground and joining them to one another while they are laid down. Once the entire battery 50 has been made up, by approaching with the machine 2 that will have mounted the moving device 1 it is possible to constrain the male lower joint 20 to the upper joint of the battery 50 formed or partially formed. In this case, by lifting the rotary head 4 along the antenna 3, the entire battery 50 formed or partially formed is then straightened in a single maneuver until it is arranged suspended and vertical. The flexible element 30 and the stop element 40 are sized to support the entire weight of the longest loadable battery. The battery 50 is rested on the ground and is held in the vertical position by closing the guides 7. Then the rotary head 4 is lowered until the upper joint is coupled with the lower joint. Then the rotary head 4 starts to descend and the tube 5 starts to rotate imposing a thrust and a rotation on the entire battery so as to plant it into the ground. Once the battery has almost totally been embedded, with the lower joint close to the ground the pegs are then removed from the lower joint, which is decoupled from the battery. Then the entire device 1 is disassembled by disconnecting it from the tube 5, always working at ground level. At this point the tube 5 is engaged into the battery 50 and locked with the transverse pegs. The battery 50 results to be operatively connected and ready for use.

In a totally analogous manner to the previous variant, it is possible to hypothesise to also make up an excavation battery for tubed drilling, made up of the assembly of auger and tube, and to use the device 1 to lift it entirely with a single maneuver and to connect it to the digging machine 2. This type of excavation battery, used in the CAP (cased auger pile) technology, comprises an auger totally analogous to that of the battery 50 described up to now, and a tube of slightly larger diameter with respect to the diameter of the coils of the auger and of shorter length with respect to the auger. It is thus possible to hypothesise making up the excavation battery 50 by keeping all of the elements 51, 52 laid on the ground and joining them to one another while they are laying down, to insert the battery of augers 50 inside the tube that will also be laid on the ground, and then provide for axially constraining the battery 50 to the tube so that during the lifting they behave in an integral manner. Finally, remembering the fact that the materials used, as well as the shapes and sizes, can be whatever according to the technical needs, the scope of protection of the invention is therefore defined by the attached claims.

The invention claimed is:

1. A device for the movement and mutual assembly of segments of an excavation battery, and for connecting said battery to a digging machine, said device comprising:

an upper joint integrally connectable to a driving tube or to a rotary head of said digging machine;

a lower joint integrally connectable to one of said segments of said excavation battery to be made up, said lower joint having an inner passing duct comprising an intermediate portion having a necking with a reduced diameter with respect to the remaining portions of said inner passing duct;

a flexible element that connects said upper joint with said lower joint, said flexible element being constrained on an upper end to said upper joint and connected on a lower end to said lower joint so that said lower joint slides along said flexible element between a disengaged extended position, in which said upper and said lower joints are separated, and an engaged contracted position, in which said upper and said lower joints are adjacent to and engaged with one another to transfer torque and axial forces from said driving tube to said excavation battery being formed; and a stop element that limits the sliding of said lower joint away from said upper joint along said flexible element, said stop element comprising a ballast constrained to the lower end of said flexible element, and having a diameter less than a diameter of an inner duct of said one of said segments of said excavation battery to slide inside said one of said segments of said excavation battery, said ballast being positioned below said necking of said lower joint and having a diameter greater than said necking, wherein in said engaged contracted condition said stop element is at a height lower than said lower joint.

2. The device according to claim 1 wherein said lower joint is rotatable around the longitudinal axis of said flexible element so as to be able to be axially aligned with said upper joint and/or with said one of said segments of said excavation battery.

3. The device according to claim 1 wherein one of said joints comprises a male coupler equipped with strips whereas the other joint comprises a female recess equipped with bayonet openings so that the coupling between said joints when the device is in the engaged contracted position takes place through a bayonet coupling system in order to transmit axial forces and torques.

4. The device according to claim 3 wherein at said bayonet openings said female lower joint comprises a plurality of reinforcing rings.

5. The device according to claim 1 wherein said upper joint is equipped with seats for inserting pegs or locking pins to said driving tube or to said rotary head, and said lower joint is equipped with seats for inserting pegs or locking pins to said one of said segments of said excavation battery.

6. A method for the movement and mutual assembly of segments of an excavation battery, and for connecting said excavation battery to a digging machine, said method being implementable with a device according to claim 1 and comprising the steps of:

a) integrally connecting said upper joint to said driving tube or to said rotary head of said digging machine while said device is in said extended disengaged condition;

b) integrally connecting said lower joint with a joint of a segment of said excavation battery to be formed or at least partially assembled or completely assembled;

c) lifting said driving tube or said rotary head until said segment or said excavation battery is vertical;

d) lowering said rotary head until said segment or said excavation battery is rested on the ground or until said segment or said excavation battery is engaged in an underlying segment of said excavation battery;

e) lowering said rotary head until said upper joint of the device engages into said lower joint and with a partial rotation of said driving tube said joints lock through a bayonet coupling, bringing said device into said engaged contracted position;

f) applying torques and pushes or pulls by means of said device through the actuation of the rotary head to plant said excavation battery being formed into the ground up to a predetermined depth;

g) counter-rotating said driving tube and lifting said rotary head to withdraw said upper joint from said lower joint;

h) raising the rotary head to arrange said device in said extended position disengaged from said excavation battery;

i) proceeding to dismount the device from the machine by withdrawing said upper joint from a joint of the driving tube; and j) lowering said rotary head until the joint of the driving tube engages into an upper joint of the excavation battery and axially fixing the driving tube to the excavation battery so that it is operatively connected to the digging machine.

7. The method according to claim 6 wherein:

after step h, steps b to h are repeated again for each segment to be added to said battery before passing to steps i and j.

8. The method according to claim 6 further comprising the steps of rotating a joint around the longitudinal axis of the flexible element to axially align said joints to one another or to axially align said lower joint with the joint of said segment to be moved.

9. The method according to claim 6 wherein during said steps a and b the connections of the joints are implemented through the use of pegs or locking pins.

* * * * *